US011660886B2

(12) United States Patent
Kim et al.

(10) Patent No.: US 11,660,886 B2
(45) **Date of Patent: *May 30, 2023**

(54) PAPER CUTTING DEVICE FOR KIOSK PRINTER AND KIOSK PRINTER EQUIPPED WITH THE SAME

(71) Applicant: BIXOLON CO., LTD., Seongnam-si (KR)

(72) Inventors: Jin Gwan Kim, Yongin-si (KR); Jin Kook Kim, Suwon-si (KR)

(73) Assignee: BIXOLON CO., LTD., Seongnam-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/564,296

(22) Filed: Dec. 29, 2021

(65) Prior Publication Data

US 2022/0118778 A1 Apr. 21, 2022

Related U.S. Application Data

(63) Continuation of application No. 16/843,983, filed on Apr. 9, 2020, now Pat. No. 11,241,895.

(30) Foreign Application Priority Data

Jun. 13, 2019 (KR) ..... 10-2019-0069777
Aug. 8, 2019 (KR) ..... 10-2019-0096792
Feb. 20, 2020 (KR) ..... 10-2020-0021029

(51) Int. Cl.
*B41J 11/70* (2006.01)
*B41J 2/32* (2006.01)
(Continued)

(52) U.S. Cl.
CPC ..... *B41J 11/706* (2013.01); *B41J 2/32* (2013.01); *B41J 11/006* (2013.01); *B41J 15/042* (2013.01)

(58) Field of Classification Search
CPC . B41J 15/042; B41J 11/006; B41J 2/32; B41J 11/706; B41J 11/666; B41J 3/36;
(Continued)

(56) References Cited

U.S. PATENT DOCUMENTS 9,409,423 B1 * 8/2016 Seng ..... B41J 11/70
2005/0281606 A1 12/2005 Koyama et al.
(Continued)

OTHER PUBLICATIONS

Notice of Allowance issued in parent U.S. Appl. No. 16/843,983 dated Oct. 4, 2021.
(Continued)

*Primary Examiner* — David H Banh
(74) *Attorney, Agent, or Firm* — Sughrue Mion, PLLC

(57) ABSTRACT

The paper cutting device includes: a lower frame configured such that a platen roller and a thermal head are disposed on the top surface thereof and provide a paper movement path and a drive unit is contained therein; an upper frame configured to form the paper movement path in association with the lower frame, and to open the paper movement path; a fixed cutter configured to be disposed on the upper frame, and to cut the roll paper; a movable cutter configured to be disposed on the lower frame, to cut the roll paper, and to allow the roll paper to move; and a jam control unit configured to detect a jam of the roll paper, and to detect the opening of the paper movement path and lower the movable cutter.

9 Claims, 19 Drawing Sheets

(51) Int. Cl.
*B41J 15/04* (2006.01)
*B41J 11/00* (2006.01)

(58) Field of Classification Search
CPC ..... B41J 3/4075; B41J 11/703; B26D 1/085; B26D 3/085; B26D 7/2614
See application file for complete search history.

(56) References Cited

U.S. PATENT DOCUMENTS

| | | | | |
|---|---|---|---|---|
| 2006/0291933 | A1 | 12/2006 | Watanabe et al. | |
| 2007/0059074 | A1 | 3/2007 | Yoshioka | |
| 2008/0024585 | A1* | 1/2008 | Kamata | B41J 25/312 347/220 |
| 2008/0069623 | A1* | 3/2008 | Kobayashi | B26D 1/085 400/621.1 |
| 2009/0032637 | A1* | 2/2009 | Yoshioka | B41J 11/70 242/562 |
| 2010/0247221 | A1* | 9/2010 | Tsugaru | B41J 11/70 400/621 |
| 2013/0101330 | A1* | 4/2013 | Yoshida | B26D 7/1863 400/621 |
| 2015/0283831 | A1* | 10/2015 | Vandermeulen | B41J 11/70 347/104 |
| 2016/0159116 | A1* | 6/2016 | Kida | B26D 5/08 347/16 |
| 2018/0134052 | A1* | 5/2018 | Campanini | B26D 5/08 |
| 2019/0347049 | A1* | 11/2019 | Nagata | B41J 29/46 |

OTHER PUBLICATIONS

Non-Final Office Action issued in parent U.S. Appl. No. 16/843,983 dated Jun. 21, 2021.

* cited by examiner

[Fig. 1]
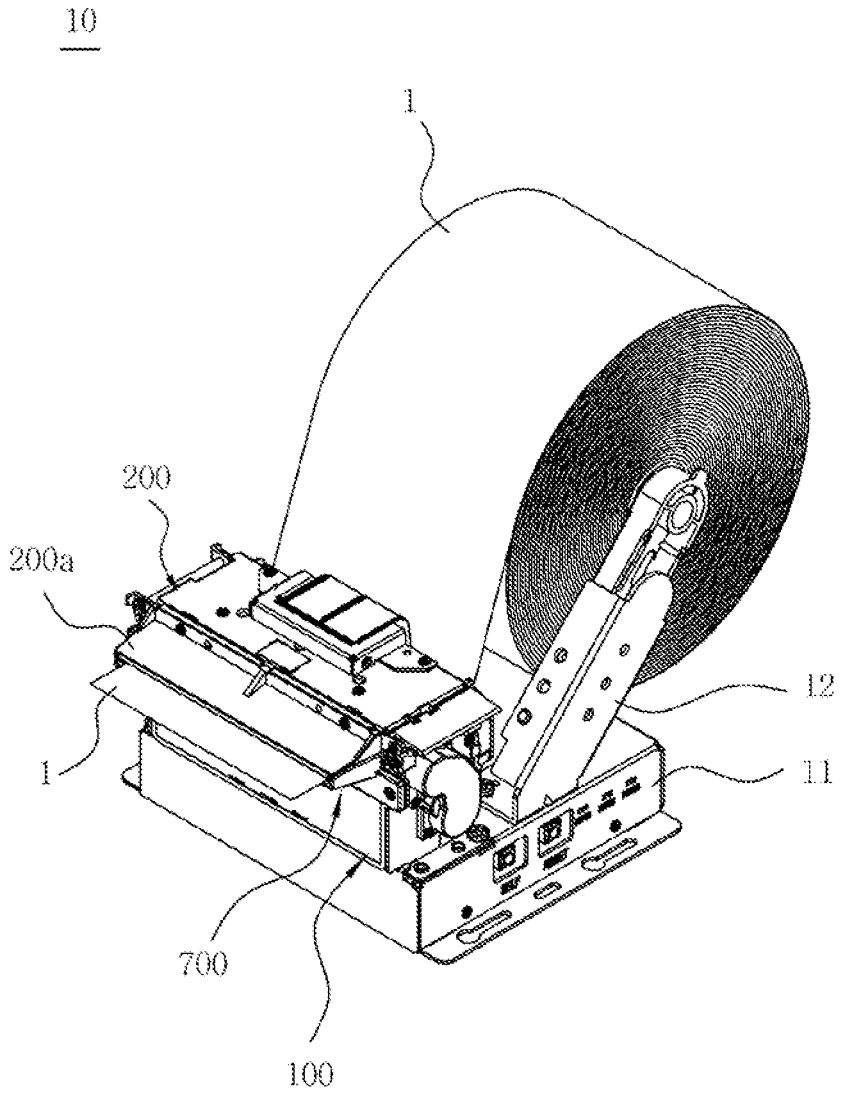

[Fig. 2]
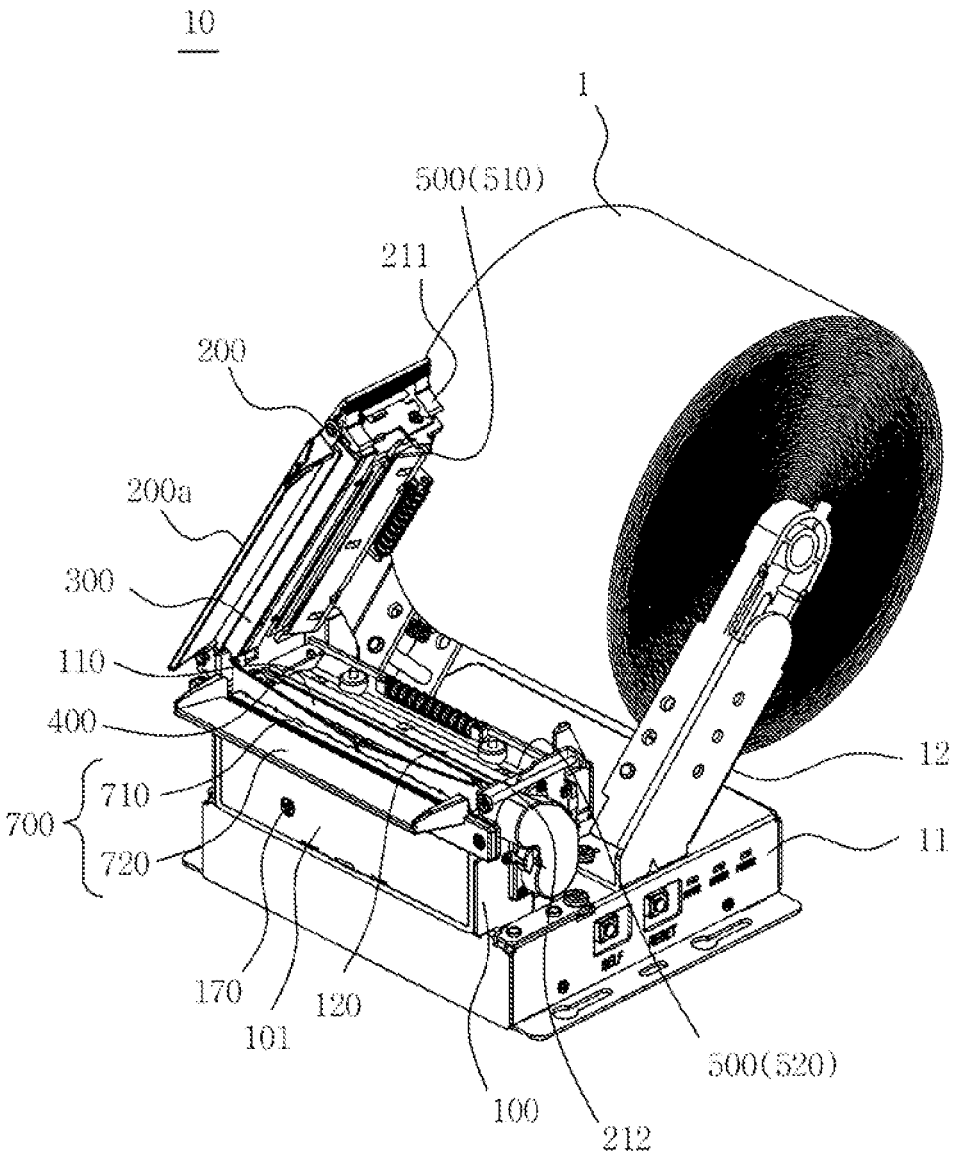

[Fig. 3]
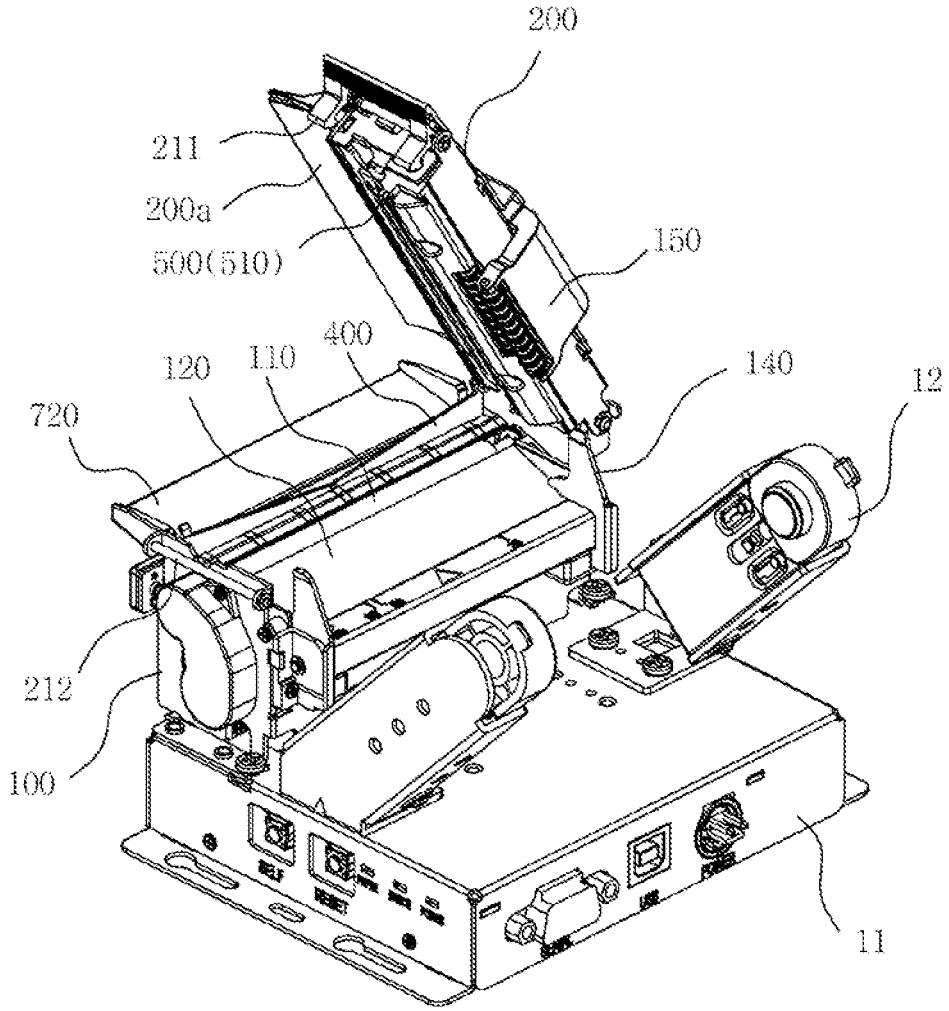

[Fig. 4]
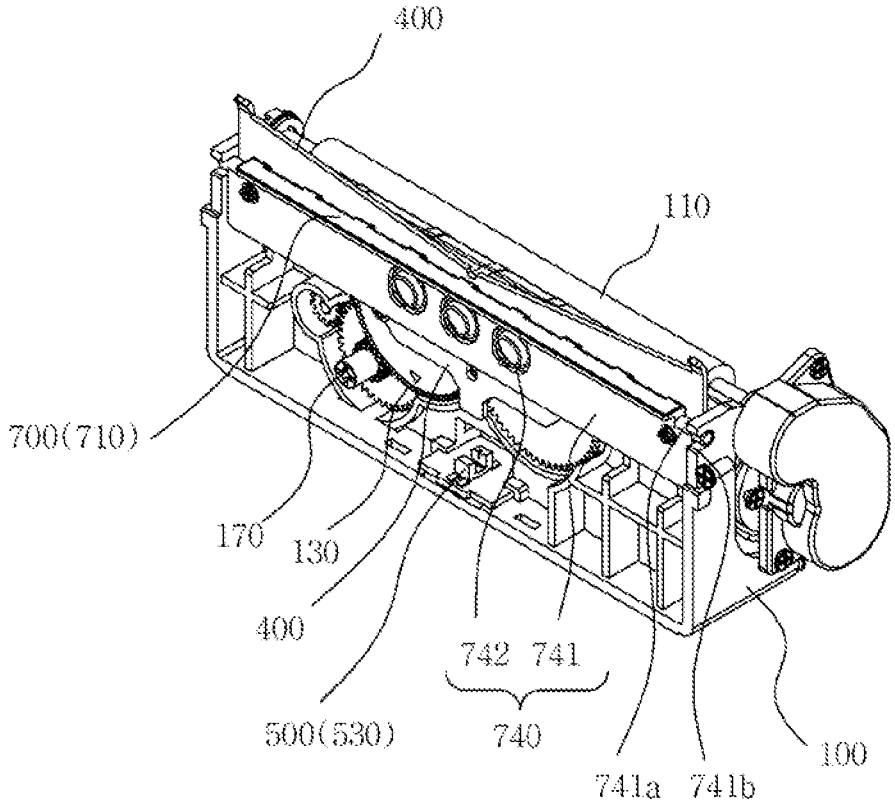

[Fig. 5]
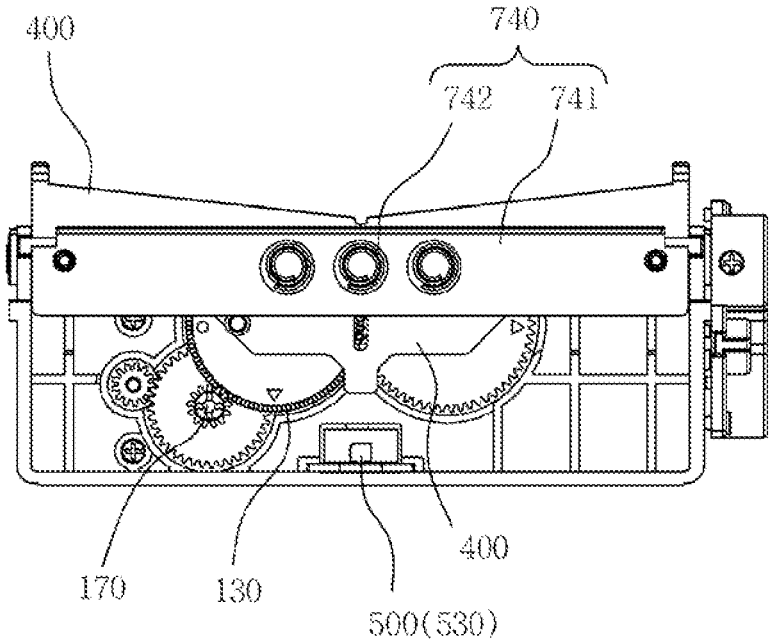

[Fig. 6]
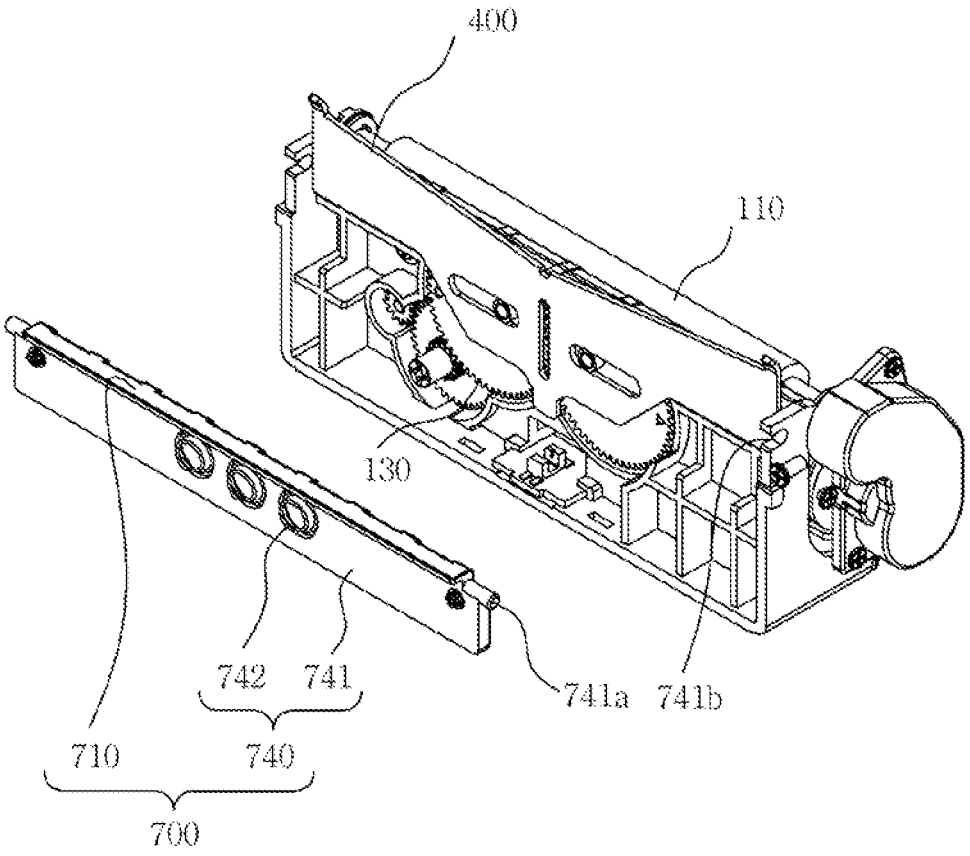

[Fig. 7]
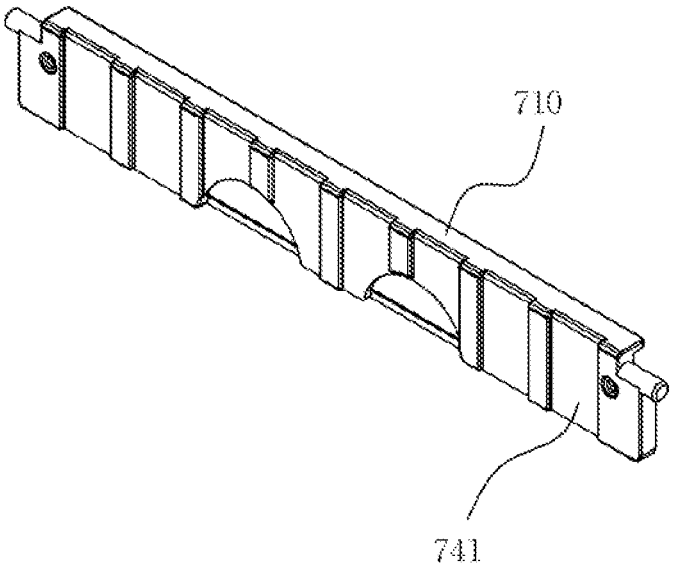

[Fig. 8]
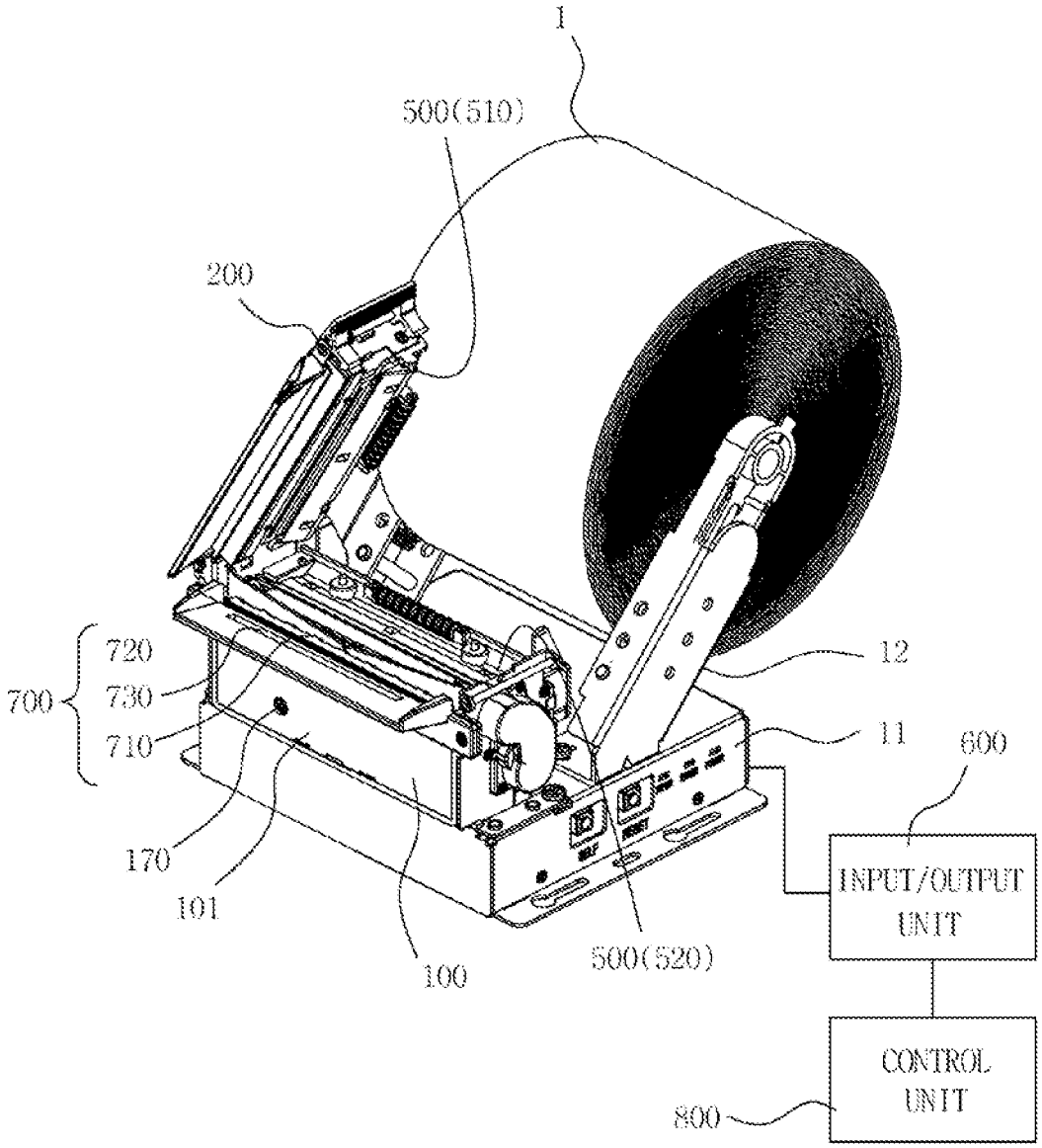

[Fig. 9]
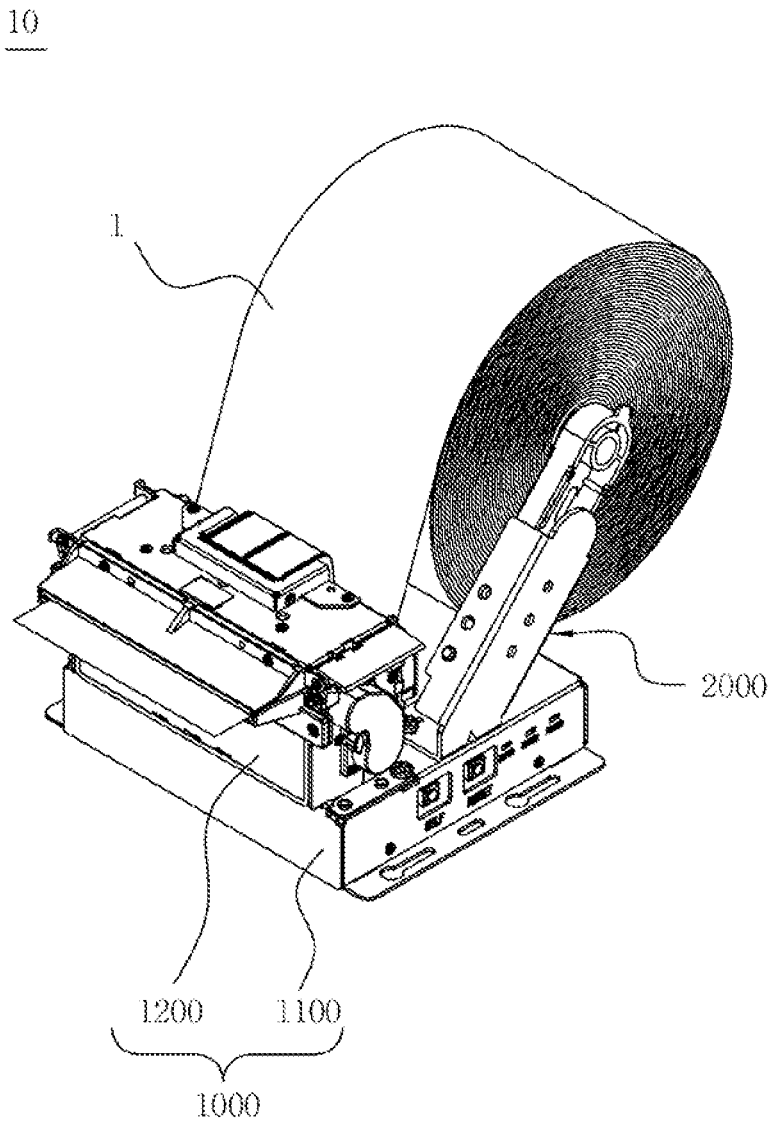

[Fig. 10]
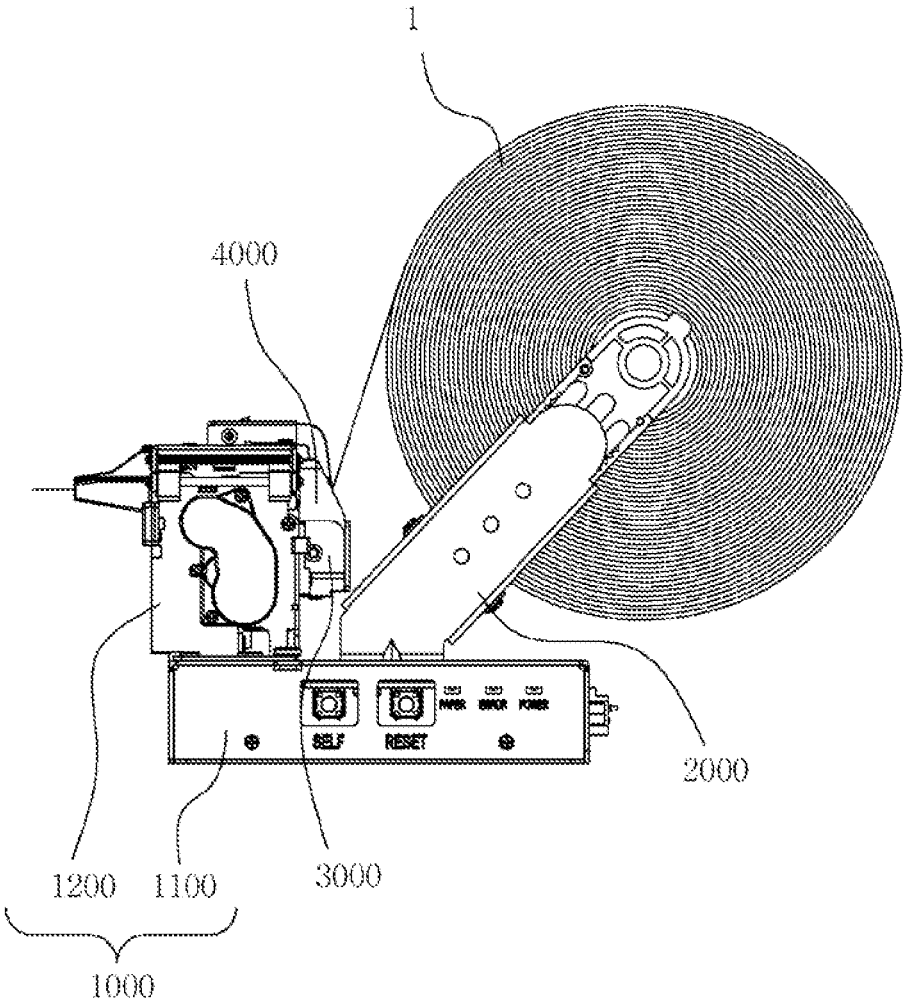

[Fig. 11]
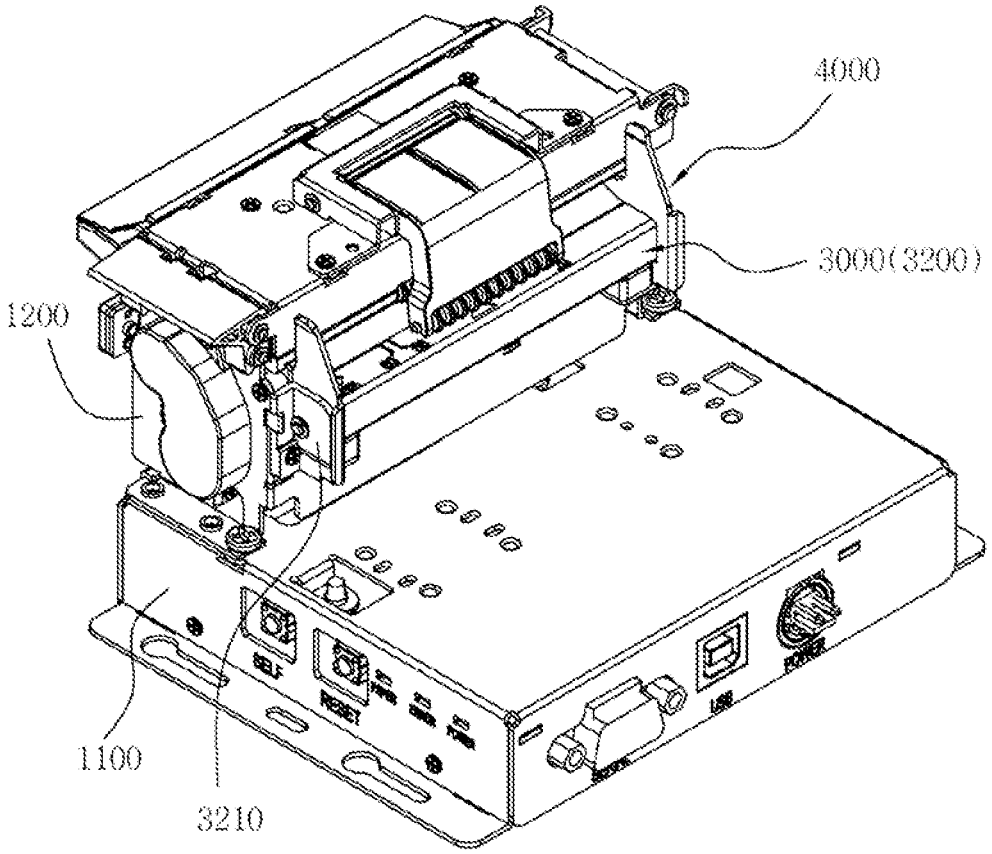

[Fig. 12]
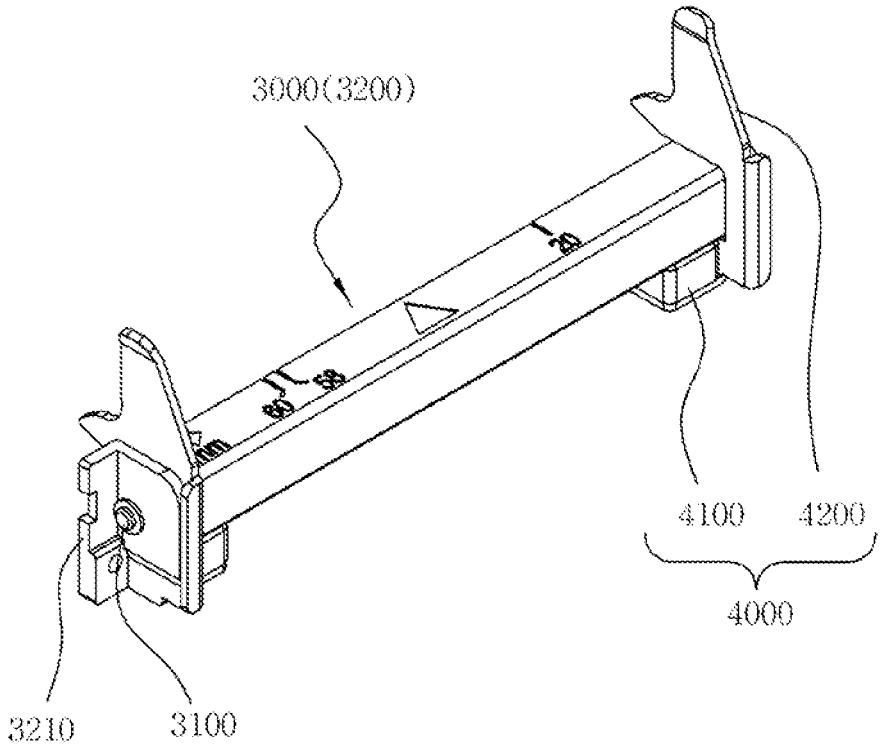

[Fig. 13]
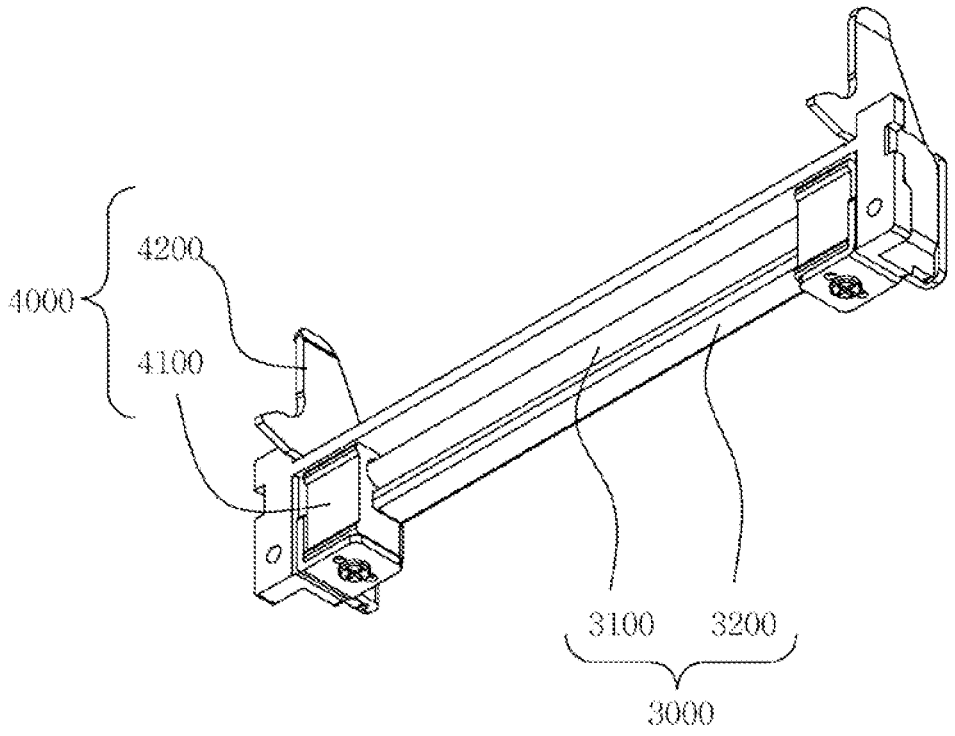

[Fig. 14]
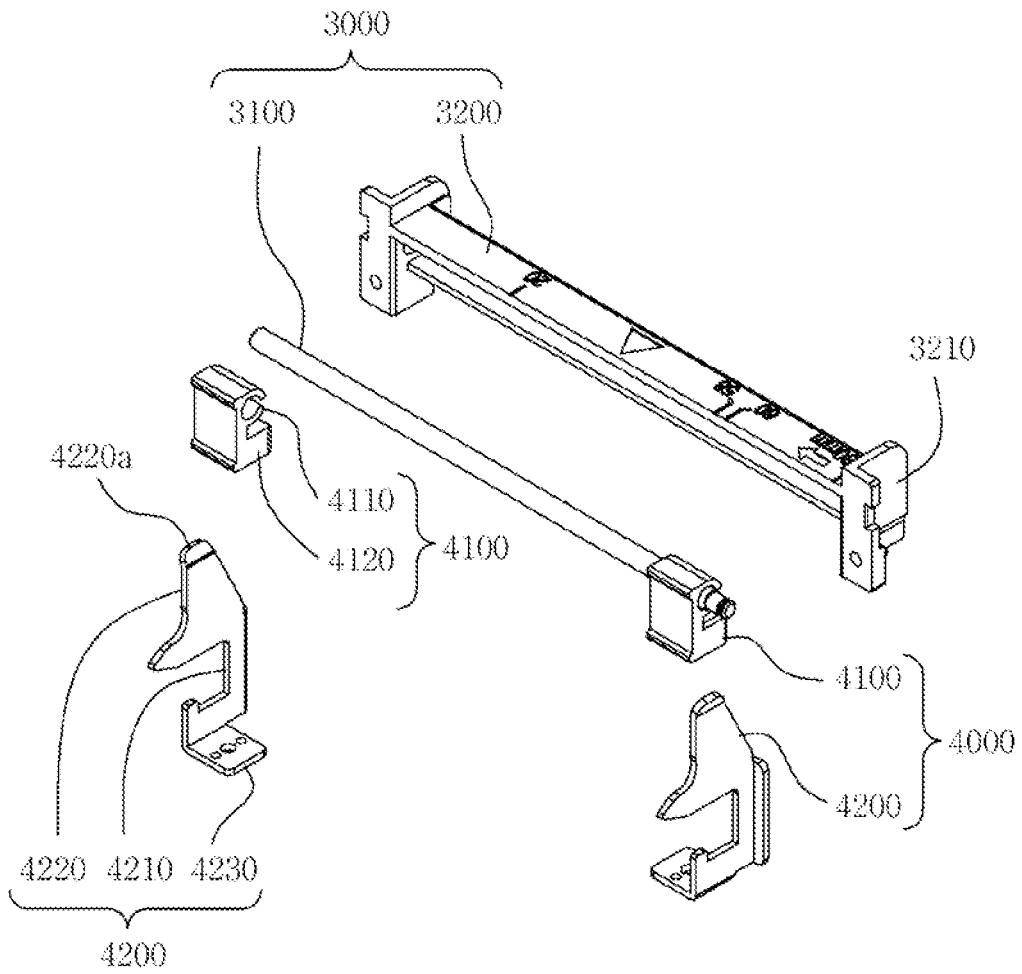

[Fig. 15]
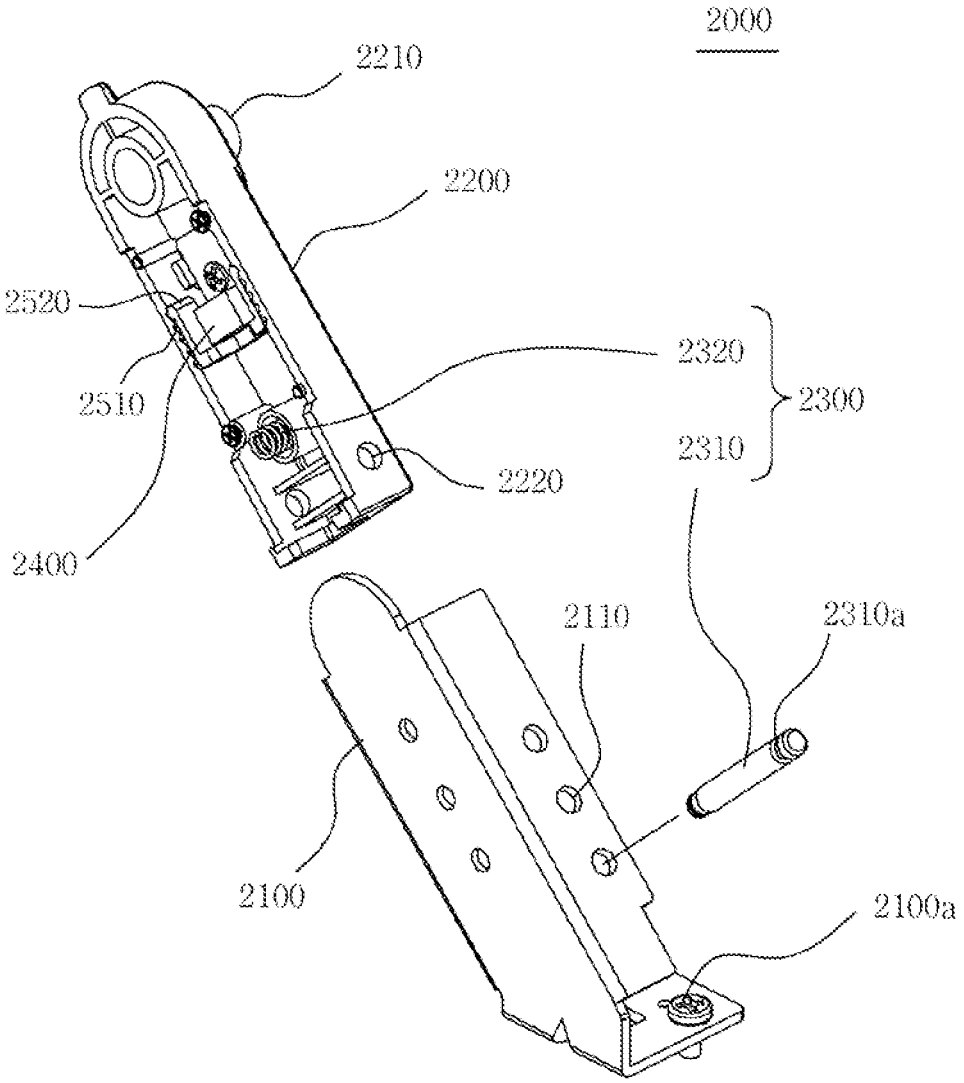

[Fig. 16]
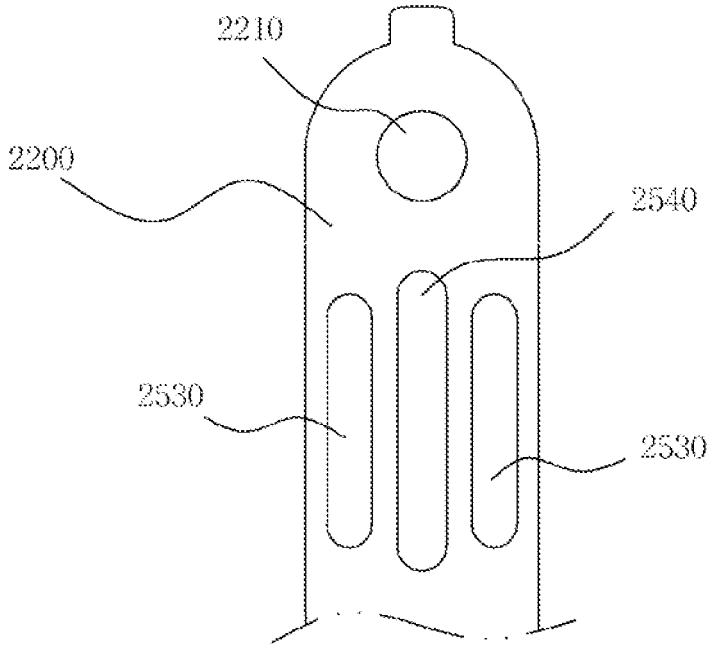

[Fig. 17]
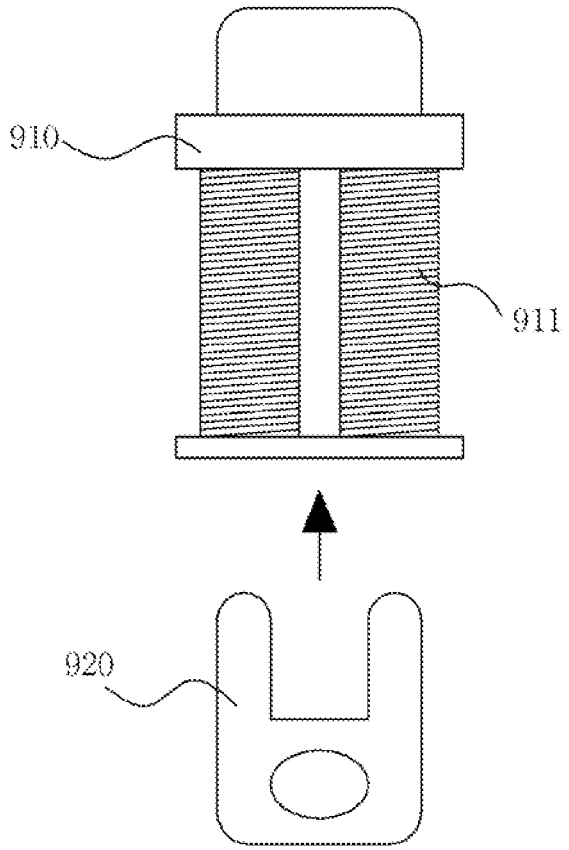

[Fig. 18]
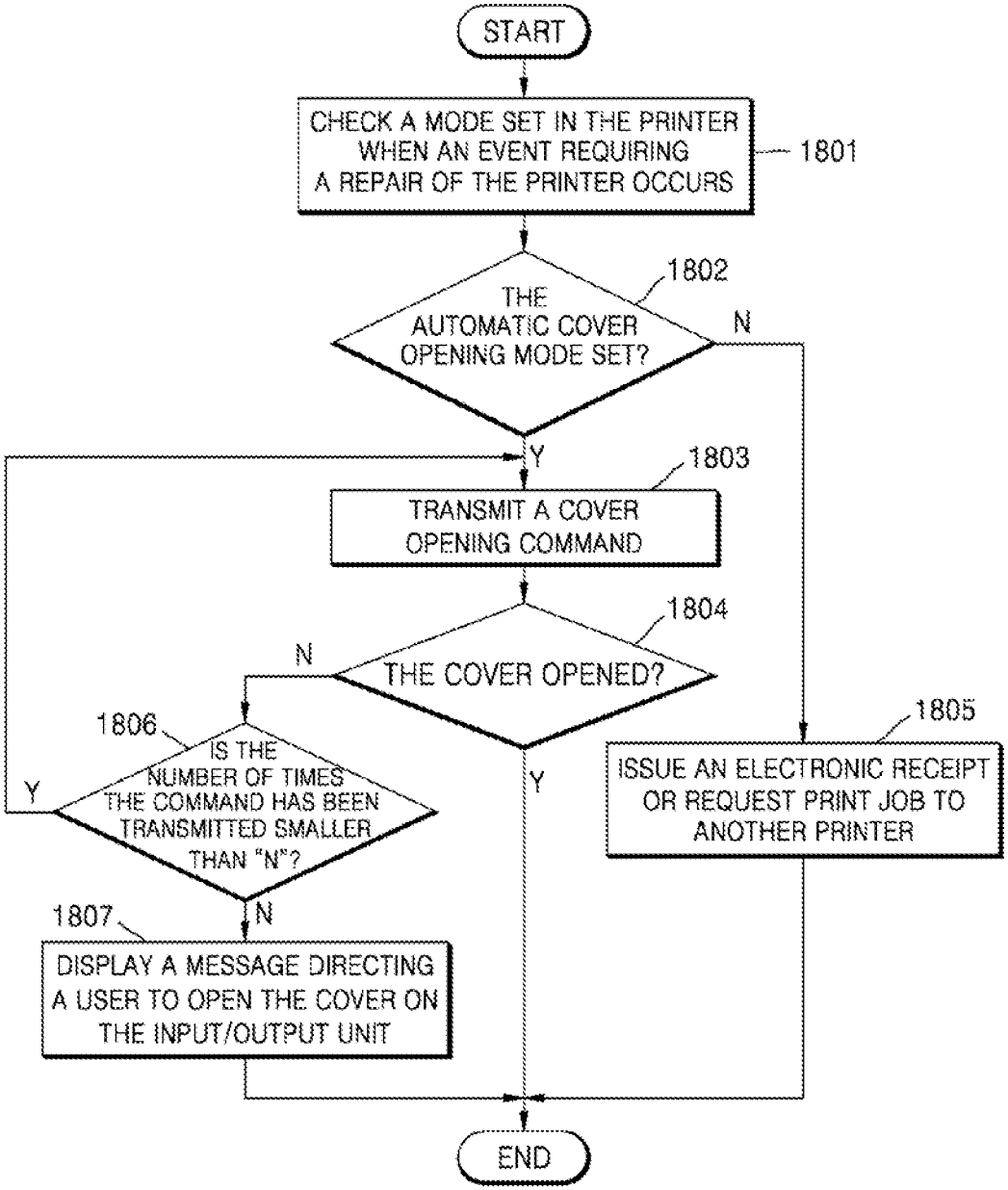

[Fig. 19]
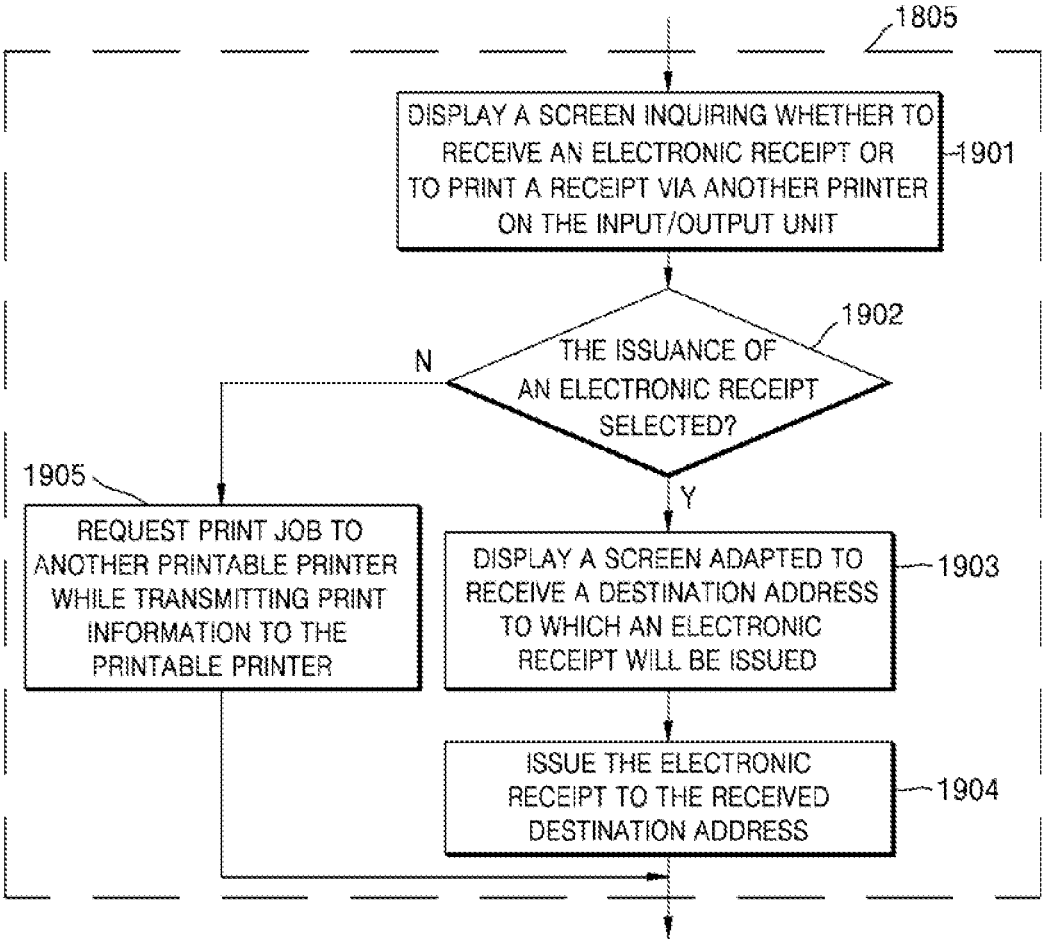

PAPER CUTTING DEVICE FOR KIOSK PRINTER AND KIOSK PRINTER EQUIPPED WITH THE SAME

CROSS-REFERENCE TO RELATED APPLICATION

This application is a continuation of U.S. application Ser. No. 16/843,983 filed Apr. 9, 2020, which claims priority from Korean Patent Application No. 10-2019-0069777 filed on Jun. 13, 2019, Korean Patent Application No. 10-2019-0096792 filed on Aug. 8, 2019, and Korean Patent Application No. 10-2020-0021029 filed on Feb. 20, 2020, which are hereby incorporated by reference herein in their entirety.

BACKGROUND

1. Technical Field

Embodiments disclosed herein relate generally to a paper cutting device for a kiosk printer and a kiosk printer equipped with the same, and more specifically to a paper cutting device for a kiosk printer, which is capable of cutting roll paper on which information is printed, and a kiosk printer equipped with the paper cutting device, a paper guide device for a kiosk printer, which is capable of guiding roll paper through movement while supporting both ends of the roll paper in its widthwise direction, and a kiosk printer equipped with the paper guide device, and a method for automatically opening and closing the cover of a printing apparatus and a printing apparatus for performing the method.

2. Description of the Related Art

In general, a kiosk refers to an apparatus which performs an unmanned informatization function such as guidance/the issuance of a certificate. When such an unmanned informatization function is performed, the printing of various types of information is essential.

A kiosk apparatus is a type of unmanned information terminal. Such kiosk apparatuses are installed in public places such as government agencies, local governments, banks, department stores and exhibition halls, and are used to provide guide services for various administrative procedures, product information, and the usage of facilities.

Furthermore, a kiosk apparatus is equipped with a touch screen, a sound card, a graphics card and a communication card, and provides efficient information to a user, e.g., in the form of a voice service, a moving picture and/or the like.

Recently, as the use of kiosk apparatuses is expanded, there is a growing demand for kiosk apparatuses which can provide various additional services as well as guide services.

For example, various kiosks such as automatic teller machines and automatic ticket machines are each provided with a printer, and thus the paper on which various types of information are printed according to the operation of a user is provided.

A common kiosk printer used for a common kiosk is constructed in such a manner that a paper supply unit configured to hold paper feed rolls, a printer head unit configured to perform printing on paper, a cutter unit configured to cut printed paper to a predetermined length, and a paper discharge unit configured to provide the cut paper to an end user are sequentially disposed and combined with one another.

In the common kiosk printer, a movable cutter configured to cut roll paper cuts roll paper while moving in a downward direction or a horizontal direction, and thus it is difficult to separate the movable cutter from a fixed cutter.

Accordingly, the conventional kiosk printer has a problem of inconvenience in that when a paper jam occurs in the process of cutting or transferring roll paper, the movable cutter cannot be opened, and paper needs to be replaced or removed in the state in which only the platen roller or the introduction portion of the container has been opened.

Furthermore, the conventional kiosk printer also has a problem of inconvenience in that when roll paper is replaced, the roll paper needs to be mounted by being inserted between the movable cutter and the fixed cutter.

As a related technology, Korean Patent No. 10-1204010 discloses a kiosk printer. In this kiosk print, a portion in which a movable cutter is disposed cannot be opened, but only a portion in which a head is disposed can be opened. Accordingly, this kiosk print has a problem in that it is inconvenient to replace or mount paper.

Meanwhile, common printers generate the paper dust of paper in the process of cutting roll paper. When paper dust is repeatedly generated and accumulated on the operating portion of a platen roller or a thermal head, a problem arises in that a breakdown of a component is caused.

Furthermore, conventional kiosk printers have a problem in that when a jam of roll paper occurs, they cannot be operated until an administrator removes the jam.

Meanwhile, in the case of common kiosk printers, guide portions configured to guide roll paper are installed with the gap therebetween fixed, and thus a problem arises in that the gap between the guide portions cannot be adjusted.

As a related technology, Korean Patent No. 10-0738895 discloses a printing unit. In this printing unit, the gap between guide portions configured to guide paper is fixed, and thus a limitation occurs in that only paper having a single width can be used.

Furthermore, according to the related technology, the height of a paper fastening part configured to fasten roll paper cannot be adjusted, and thus a problem arises in that roll paper cannot be mounted when the size of the roll paper is large.

Furthermore, the related technology has a problem in that it is difficult to check the residual amount of roll paper which is coupled to the paper fastening part.

Moreover, the related technology has a problem in that when a problem, such as a paper jam or a paper shortage, occurs while a user is printing a receipt or the like using a kiosk printer and thus it is necessary to repair the internal configuration of the printer, it is inconvenient to directly open the cover of the printer for repair or a general user cannot directly repair the configuration even when the cover is opened.

Therefore, there is a demand for a technology which is capable of overcoming the above-described problems.

Meanwhile, the above-described background technology corresponds to technical information that has been possessed by the present inventor in order to contrive the present invention or which has been acquired in the process of contriving the present invention, and can not necessarily be regarded as well-known technology which had been known to the public prior to the filing of the present invention.

SUMMARY

An object of embodiments disclosed herein is to propose a paper cutting device for a kiosk printer and a kiosk printer equipped with the same, in which a paper movement path formed by a movable cutter and a fixed cutter is configured to be openable, thereby enabling roll paper to be easily replaced or mounted when a paper jam occurs or roll paper is replaced.

An object of embodiments disclosed herein is to propose a paper cutting device for a kiosk printer and a kiosk printer equipped with the same, in which a movable cutter is configured to perform cutting while being raised in a vertical direction and the movable cutter is lowered when a paper movement path is opened, thereby enabling a safety-related accident to be prevented.

An object of embodiments disclosed herein is to propose a paper cutting device for a kiosk printer and a kiosk printer equipped with the same, in which a movable cutter can be manually raised as desired, and thus a paper jam is removed or paper is mounted by forcibly raising the movable cutter in a situation such as a power failure.

An object of embodiments disclosed herein is to propose a paper cutting device for a kiosk printer and a kiosk printer equipped with the same, in which a pressing member configured to bring a movable cutter into close contact with a fixed cutter is provided to smoothly perform pressing even within a narrow space.

An object of embodiments disclosed herein is to propose a paper cutting device for a kiosk printer and a kiosk printer equipped with the same, in which paper dust generated during the cutting of roll paper can be discharged to the outside by a pressing member.

An object of embodiments disclosed herein is to propose a paper cutting device for a kiosk printer and a kiosk printer equipped with the same, in which a jam of roll paper can be detected and printing target information can be provided via a display even when a jam of roll paper is not removed by an administrator in the case where the jam is detected.

An object of embodiments disclosed herein is to propose a paper cutting device for a kiosk printer and a kiosk printer equipped with the same, which when a jam of roll paper occurs, can provide an environment for the input of external information or present another kiosk printer capable of performing output.

An object of embodiments disclosed herein is to propose a paper cutting device for a kiosk printer and a kiosk printer equipped with the same, which can guide roll paper through its movement while supporting both ends of the roll paper in the widthwise direction of the roll paper and which can particularly deal with the varying width of roll paper because guide members are configured to be movable by external force.

An object of embodiments disclosed herein is to propose a paper cutting device for a kiosk printer and a kiosk printer equipped with the same, which can protect a rail, to which guide members are coupled, from an external environment by preventing the rail from being exposed to the outside.

An object of embodiments disclosed herein is to propose a paper cutting device for a kiosk printer and a kiosk printer equipped with the same, in which guide members are fitted over a rail via elastic force acting in a retraction direction, and thus the guide members can provide supporting force at set locations and can be easily moved by external force.

An object of embodiments disclosed herein is to propose a paper cutting device for a kiosk printer and a kiosk printer equipped with the same, which allow roll paper to be mounted regardless of the size of the roll paper and which can detect the residual amount of roll paper.

An object of embodiments disclosed herein is to propose a method for automatically opening and closing the cover of a printing apparatus such as a kiosk printer or taking other appropriate measures when an event requiring a repair occurs in the printing apparatus, and a printing apparatus for performing the same.

As a technical solution for accomplishing the above objects, according to an embodiment, there is provided a paper cutting device for a printer, the paper cutting device cutting roll paper which is printed with information by a thermal head while being moved by the traction force of a platen roller, the paper cutting device including: a lower frame configured such that the platen roller and the thermal head are disposed on the top surface thereof and provide a paper movement path for the roll paper to the top surface and a drive unit for providing driving force is contained therein; an upper frame configured to form the paper movement path for the roll paper in association with the lower frame in the state of being coupled to the top surface of the lower frame, and to be separated from the lower frame and open the paper movement path, thereby allowing the roll paper to be replaced or mounted; a fixed cutter configured to be disposed on the upper frame, and to cut the roll paper; a movable cutter configured to be disposed on the lower frame to be reciprocated, to be operated by the drive unit, to cut the roll paper in association with the fixed cutter while being raised to the fixed cutter, and to allow the roll paper to move by being raised to the lower frame; and a jam control unit configured to detect a jam of the roll paper by detecting the operating status of the movable cutter, and to detect the opening of the paper movement path performed by the upper frame and lower the movable cutter to the lower frame.

As a technical solution for accomplishing the above objects, according to an embodiment, there is provided a paper guide device for a kiosk printer, the paper guide device being provided in the housing of the kiosk printer and discharging roll paper toward a thermal head via the traction force of a platen roller while guiding the roll paper at a set width, the paper guide device including: a paper holder configured to be disposed in the housing, to rotatably hold the roll paper, and to draw out the roll paper via the traction force of the platen roller; a rail member configured to be disposed between the paper holder and the thermal head, and to provide a movement path in the widthwise direction of the roll paper; and a pair of guide members configured to be movably coupled to the rail member, to be moved in the longitudinal direction of the rail member by external force, to include two guide members symmetrical to each other, and to guide the roll paper to the thermal head while supporting both ends of the roll paper in the widthwise direction of the roll paper.

BRIEF DESCRIPTION OF THE DRAWINGS

The above and other objects, features, and advantages of the present invention will be more clearly understood from the following detailed description taken in conjunction with the accompanying drawings, in which:

FIG. 1 is a perspective view showing a kiosk printer in which a paper cutting device for a printer according to an embodiment is installed;

FIGS. 2 and 3 are perspective views showing the paper cutting device for a kiosk printer according to the embodiment with an upper frame opened;

FIG. 4 is a perspective view showing the internal structure of the lower frame of the paper cutting device for a kiosk printer according to the embodiment;

FIG. 5 is a front view showing the internal structure of the lower frame of the paper cutting device for a kiosk printer according to the embodiment;

FIG. 6 is a perspective view showing the paper dust discharge unit of the paper cutting device for a kiosk printer according to the embodiment FIG. 7 is a perspective view showing the pressing plate shown in FIG. 6 when it is viewed from the opposite direction;

FIG. 8 is a perspective view showing the paper dust discharge unit of the paper cutting device for a kiosk printer according to the embodiment;

FIG. 9 is a perspective view showing a kiosk printer in which a paper guide device for a kiosk printer according to an embodiment is installed;

FIG. 10 is a side view of the kiosk printer in which the paper guide device for a kiosk printer according to the embodiment is installed;

FIG. 11 is a perspective view showing the paper guide device for a kiosk printer according to the embodiment with a paper holder removed therefrom;

FIG. 12 is a perspective view showing the rail member and guide members of the paper guide device for a kiosk printer according to the embodiment;

FIG. 13 is a bottom perspective view showing the rail member and guide members shown in FIG. 12 when they are viewed from the opposite direction;

FIG. 14 is an exploded perspective view showing the rail member and guide members of the paper guide device for a kiosk printer according to the embodiment;

FIG. 15 is an exploded perspective view showing the paper holder of the paper guide device for a kiosk printer according to the embodiment;

FIG. 16 is a view showing the configuration of the paper tube coupling rod shown in FIG. 15;

FIG. 17 is a view showing the configuration of a solenoid opening/closing member according to an embodiment; and FIGS. 18 and 19 are flowcharts illustrating a method of automatically opening a cover when an event requiring a repair of a kiosk printer occurs according to an embodiment.

DETAILED DESCRIPTION

Various embodiments will be described in detail below with reference to the accompanying drawings. The following embodiments may be modified to various different forms and then practiced. In order to more clearly illustrate the features of the embodiments, detailed descriptions of items which are well known to those having ordinary skill in the art to the following embodiments pertain will be omitted. In the drawings, portions unrelated to the following description will be omitted. Throughout the specification, like reference symbols will be assigned to like portions.

Throughout the specification and the claims, when one component is described as being "connected" to another component, the one component may be "directly connected" to the other component or "electrically connected" to the other component through a third component. Furthermore, when any portion is described as including any component, this does not mean that the portion does not exclude another component but means that the portion may further include another component, unless explicitly described to the contrary.

The embodiments will be described in detail below with reference to the accompanying drawings.

FIG. 1 is a perspective view showing a kiosk printer in which a paper cutting device for a printer according to an embodiment is installed, FIGS. 2 and 3 are perspective views showing the paper cutting device for a kiosk printer according to the embodiment with an upper frame opened, and FIG. 4 is a perspective view showing the internal structure of the lower frame of the paper cutting device for a kiosk printer according to the embodiment. Furthermore, FIG. 5 is a front view showing the internal structure of the lower frame of the paper cutting device for a kiosk printer according to the embodiment, FIG. 6 is a perspective view showing the pressing member of the paper cutting device for a kiosk printer according to the embodiment, FIG. 7 is a perspective view showing the pressing plate shown in FIG. 6 when it is viewed from the opposite direction, and FIG. 8 is a perspective view showing the paper dust discharge unit of the paper cutting device for a kiosk printer according to the embodiment.

The paper cutting device according to the present embodiment is a device which is installed on a base frame 11 constituting a part of a printer 10 and cuts and discharges roll paper 1 on which information is printed.

More specifically, the paper cutting device according to the present embodiment may include a lower frame 100, an upper frame 200, a fixed cutter 300, a movable cutter 400, and a jam control unit 500, as shown in FIGS. 1 to 3.

In this case, the base frame 11 constituting a part of the printer 10 may be fastened to a printer case (not shown), and may contain various types of control modules for printing operations.

Furthermore, a paper holder 12 configured to detect the amount of remaining roll paper 1 via a residual amount detection sensor while supporting the roll paper 1 to be drawn out may be disposed on the base frame 11, and may feed the roll paper 1.

The lower frame 100 is intended to discharge the roll paper 1 after the operation of performing printing on the roll paper 1. The lower frame 100 may be disposed on the top surface of the base frame 11.

The lower frame 100 may be provided with a platen roller 110 configured to pull roll paper via rotating force and a thermal head 120 configured to perform a printing operation on one surface of the roll paper 1 on the top surface thereof, as shown in FIGS. 2 and 3, thereby providing the paper movement path of the roll paper 1 to the top surface thereof.

Furthermore, the lower frame 100 may be provided with a guide unit 140 configured to guide the roll paper 1, as shown in FIG. 3.

Furthermore, the lower frame 100 may be provided with a drive unit 130 and operate the movable cutter 400, as shown in FIGS. 4 and 5.

In this case, the platen roller 110 and the movable cutter 400 may be operated by respective drive motors (not shown).

The upper frame 200 is a component which is separably coupled to the top surface of the lower frame 100 and forms a paper movement path in association with the lower frame 100, and provides a portion on which the fixed cutter 300 to be described later is installed.

The upper frame 200 is installed such that one of both ends thereof in the longitudinal direction thereof is hinged to the top surface of the lower frame 100 and the other end thereof pivots, and may be selectively coupled to or separated from a lower fastening rod 212, provided on the lower frame 100, via an upper hook 211 provided on the other end of the upper frame 200.

More specifically, the upper frame 200 may form the paper movement path in association with the lower frame 100 through the coupling of the upper hook 211 and the lower fastening rod 212 to each other, and the paper movement path may be opened through the separation of the upper hook 211 and the lower fastening rod 212 from each other, thereby allowing the roll paper 1 to be replaced or installed.

Furthermore, the upper frame 200 may be provided with a roller unit 150 configured to guide the roll paper 1 in a horizontal state while guiding the roll paper 1 to the thermal head, as shown in FIG. 3.

Meanwhile, the upper frame 200 and the lower frame 100 may selectively open and close the paper movement path while being selectively coupled to and separated from each other via a solenoid opening/closing member 900 using the magnetism of a solenoid, other than the above-described mechanical configuration using the upper hook 211 and the lower fastening rod 212, as shown in FIG. 17.

The solenoid opening/closing member 900 may be configured to include a yoke 910 installed on one of the upper frame 200 and the lower frame 100 and configured to selectively provide magnetism, and a metal chip 920 installed on the other of the upper frame 200 and the lower frame 100 and coupled to the yoke 910 by the magnetism of the yoke 910.

More specifically, the yoke 910 may be composed of an electromagnet wound around a coil 911, and may be controlled by a control unit 800 to be described below. The yoke 910 may be normally coupled to the metal chip 920 through magnetism and may thus couple the upper frame 200 to the lower frame 100, thereby forming a paper movement path.

Furthermore, when a current flows through the coil 911 wound around the yoke 910, magnetism is instantaneously removed to thus allow the separation of the metal chip 920, and thus the paper movement path is opened through the separation of the upper frame 200 and the lower frame 100, thereby allowing the replacement or installation of the roll paper 1.

Alternatively, on the contrary, the yoke 910 on which the coil 911 is wound may be configured to have magnetism when a current flows through the coil 911 and to remove magnetism in normal times in which no current flows through the coil 911.

Meanwhile, the above-described solenoid opening/closing member 900 may be also provided in a cover (not shown) and a housing (not shown) constituting the kiosk printer 10 and selectively open and close the cover. In this case, when the cover is opened, a user or an administrator may access the internal components of the printer including the paper cutting device for the printer described herein, and may thus perform repair and maintenance on the printer.

The fixed cutter 300 is a component which cuts the roll paper 1 in association with the movable cutter 400 to be described later, and may be installed in the state of being fixed to the upper frame 200, as shown in FIG. 2.

In other words, the fixed cutter 300 is fixed to the upper frame 200 and is separated from the movable cutter 400 by being selectively opened and closed along with the upper frame 200, thereby opening the paper movement path.

The movable cutter 400 is a component which cuts the roll paper 1 in association with the fixed cutter 300 while being reciprocated by the above-described drive unit 130.

More specifically, the movable cutter 400 may be installed on the lower frame 100 to be raised, and may be reciprocated by the drive unit 130. The movable cutter 400 may be raised to the fixed cutter 300, thereby cutting the roll paper 1, and the movable cutter 400 may be lowered to the lower frame 100, thereby allowing the roll paper 1 to move.

The movable cutter 400 is disposed on the lower frame 100 other than the upper frame 200 and forms a vertically raisable structure, thereby providing a structure which allows the upper frame 200 to be easily opened. Accordingly, the paper movement path can be opened when a paper jam occurs or the roll paper 1 is replaced.

The jam control unit 500 is a component which detects a jam of the roll paper 1 while detecting the operating status of the above-described movable cutter 400 and lowers the movable cutter 400 to the lower frame 100 when the paper movement path is opened by the upper frame 200, thereby preventing a safety-related accident which may be caused by the movable cutter 400.

More specifically, the jam control unit 500 may include a detection protrusion 510, a first home sensor 520, and a second home sensor 530 (see FIG. 4).

The detection protrusion 510 may protrude from a part of the upper frame 200.

The first home sensor 520 is configured to detect the detection protrusion 510. The first home sensor 520 may be installed on the lower frame 100, and may detect the separation of the detection protrusion 510 while forming a coupling portion for the detection protrusion 510.

The first home sensor 520 may be implemented as, e.g., a Hall sensor, an optical sensor, an infrared sensor, or the like, and may detect the detection protrusion 510. When the detection protrusion 510 is separated, the first home sensor 520 may apply a detection signal to the above-described drive unit 130.

When a detection signal of the first home sensor 520 is applied, the drive unit 130 may lower the movable cutter 400 while operating.

The second home sensor 530 is a component which controls the operation of the drive unit 130 while detecting the operating status of the movable cutter 400 and a jam of the roll paper 1.

More specifically, the second home sensor 530 is installed on the lower frame 100, as shown in FIGS. 4 and 5. The second home sensor 530 may detect the operating period of the movable cutter 400 while detecting the lower end of the movable cutter 400, and may detect a jam of the roll paper 1 based on the detected operating period.

In other words, the second home sensor 530 may compare the operating period of the movable cutter 400 with the normal operating period of the movable cutter 400, and may determine that a jam of the roll paper 1 has occurred and stop the operation of the drive unit 130 when the movable cutter 400 has not been lowered to the lower end within a predetermined period.

Furthermore, when the separation of the detection protrusion 510 is detected by the first home sensor 520 and simultaneously the movable cutter 400 is lowered, the second home sensor 530 may detect the lower end of the movable cutter 400 and stop the operation of the drive unit 130, thereby stopping the movable cutter 400 in a lowered state.

Meanwhile, the paper cutting device for a printer according to the present embodiment may further include a manual control unit 170, as shown in FIGS. 4 and 5.

The manual control unit 170 is a component which forcibly operates the movable cutter 400 by manually operating the movable cutter 400. The manual control unit 170 may provide a coupling portion for a tool, such as a driver, in the state of being connected to the drive unit 130.

In other words, the manual control unit 170 may be manually rotated and operate the drive unit 130 when a situation such as a power failure occurs, thereby enabling the movable cutter 400 to be manually raised.

The manual control unit 170 may be installed on the cover 101 of the lower frame 100 in an exposed state, as shown in FIG. 2.

Meanwhile, the paper cutting device for a printer according to the present embodiment may further include a paper dust discharge unit 700, as shown in FIG. 2.

The paper dust discharge unit 700 is a component which discharges paper dust, which is generated from the roll paper 1 during cutting using the movable cutter 400, to the outside through a pressing member 740.

More specifically, the paper dust discharge unit 700 may include a paper dust guide plate 710 and a lower bezel 720, as shown in FIG. 2.

The paper dust guide plate 710 is a component which guides paper dust, falling from the roll paper 1, to the outlet of the paper movement path and then discharges the paper dust.

More specifically, the paper dust guide plate 710 is formed in a plate shape, is installed on the top of the lower frame 100 in the longitudinal direction of the movable cutter 400, and extends in the transfer direction of the roll paper 1, thereby guiding paper dust to the lower bezel 720 to be described later and then discharging the paper dust.

The paper dust guide plate 710 is inclined downward in the direction of the lower bezel 720, thereby smoothly discharging paper dust to the lower bezel 720.

The lower bezel 720 is a component which is installed on the lower frame 100 while forming a state of being adjacent to the paper dust guide plate 710 and forms the outlet of the paper movement path. The lower bezel 720 may receive paper dust from the paper dust guide plate 710, and may discharge the paper dust to the outside.

Meanwhile, the lower bezel 720 is provided with a paper dust discharge hole 730 formed in an elongated hole shape, thereby discharging the paper dust, discharged by the paper dust guide plate 710, to the outside, as shown in FIG. 8.

On the other hand, an upper bezel 200*a* corresponding to the lower bezel 720 may be installed on the above-described upper frame 200.

The upper bezel 200*a* may be installed on the upper frame 200, and may form the outlet of the paper movement path in association with the lower bezel 720. The upper bezel 200*a* may support the cut roll paper 1 in the state of facing the lower bezel 720, thereby preventing the roll paper 1 from falling.

The paper dust discharge unit 700 according to the present embodiment may further include the pressing member 740, as shown in FIGS. 4 to 7.

The pressing member 740 is a component which when the movable cutter 400 is raised, presses a part of the movable cutter 400 and brings the part of the movable cutter 400 into close contact with the fixed cutter 300, thereby enabling smooth cutting to be performed.

In particular, the pressing member 740 is a component which reciprocates the paper dust guide plate 710 in the longitudinal direction of the paper movement path so that the paper dust of the above-described paper dust guide plate 710 can be smoothly discharged to the lower bezel 720.

More specifically, the pressing member 740 may include a pressing plate 741 and pressing springs 742.

The pressing plate 741 is contained in the upper end portion of the lower frame 100, and is disposed between the cover 101 of the lower frame 100 and the movable cutter 400 so that one surface thereof may face the cover 101 of the lower frame 100 and the opposite surface thereof may face the movable cutter 400.

The pressing plate 741 may be coupled to sliding recesses 741*b* formed in the lower frame 100 in elongated recess shapes via sliding protrusions 741*a* provided at both ends of the pressing plate 741 in the longitudinal direction of the pressing plate 741, as shown in FIG. 6.

Accordingly, the pressing plate 741 may move in the direction of the movable cutter 400 or move in the opposite direction while moving along the sliding recesses 741*b*.

More specifically, one surface of the pressing plate 741 may be pressed in the direction of the movable cutter 400 by the pressing springs 742, which will be described later. The pressing plate 741 may be reciprocated in a horizontal direction in such a manner that the pressing plate 741 is made to face the movable cutter 400 by the raising of the movable cutter 400 or is separated from the movable cutter 400 by the lowering of the movable cutter 400.

In this case, the pressing plate 741 is integrated with the paper dust guide plate 710 and thus reciprocates the paper dust guide plate 710 in the longitudinal direction of the paper transfer path, as shown in FIGS. 6 and 7.

In other words, the paper dust guide plate 710 may be formed on the upper end portion of the pressing plate 741 while forming the state of being perpendicular to the pressing plate 741, and may extend toward the lower bezel 720. The paper dust guide plate 710 may smoothly discharge paper dust to the lower bezel 720 while reciprocating along with the pressing plate 741 which reciprocates along the sliding recesses 741*b* in the horizontal direction.

The pressing springs 742 are components which press the pressing plate 741 toward the movable cutter 400 by pressing the pressing plate 741 via their elastic force. The pressing springs 742 may include one or more coil springs, and may support the cover 101 constituting a part of the lower frame 100 in the state of being fastened to one surface of the pressing plate 741.

In other words, the pressing springs 742 may provide elastic force in the state of supporting the cover 101 constituting a part of the lower frame 100, thereby pressing the pressing plate 741 toward the movable cutter 400.

Accordingly, when the movable cutter 400 is lowered, the pressing plate 741 may move along the sliding recesses 741*b* and may block an outlet through which the movable cutter 400 is drawn out. Furthermore, when the movable cutter 400 is raised, the pressing plate 741 may be moved in the opposite direction by the movable cutter 400, and may press the movable cutter 400 by opening the outlet, thereby bringing the movable cutter 400 to close contact with the fixed cutter 300.

In this case, the pressing springs 742 include a plurality of pressing springs, and are disposed in the central portion of the pressing plate 741 in the longitudinal direction of the pressing plate 741, thereby pressing the central portion of the movable cutter 400.

Furthermore, the pressing springs 742 may be implemented as conical springs in which the diameter of the coil is gradually reduced in a direction which is away from the pressing plate 741.

In other words, the pressing springs 742 are implemented as conical springs, and may be thus disposed within the narrow space of the lower frame 100.

The operation of the kiosk printer 10, to which the paper cutting device including the above-described components is applied, will be described below.

When the roll paper 1 is installed, the upper frame 200 may be opened out of the lower frame 100 through the separation of the upper hook 211 and the lower fastening rod 212 from each other, thereby opening a paper transfer path.

In this case, the first home sensor 520 may detect the separation of the detection protrusion 510 moving along with the upper frame 200 and apply a detection signal to the drive unit 130, and the drive unit 130 may lower the movable cutter 400 to the lower frame 100 while operating in response to the detection signal of the first home sensor 520.

Furthermore, when the lower end portion of the lowered movable cutter 400 is detected, the second home sensor 530 may stop the operation of the drive unit 130 by applying a detection signal.

After the roll paper 1 has been mounted on the paper holder 12, the front end of the roll paper 1 may be drawn out and seated on the top surface of a paper transfer path formed by the top surface of the lower frame 100 and the lower bezel 720.

The upper frame 200 is lowered and coupled to the lower frame 100 through the fastening of the upper hook 211 and the lower fastening rod 212 to each other, thereby completing the installation of the roll paper 1.

When printing is performed, the roll paper 1 may be printed with printing target information via the thermal head 120 while being moved by the platen roller 110, and may be then cut by the movable cutter 400 and discharged.

In this case, the movable cutter 400 may cut the printing paper in association with the fixed cutter 300 while being raised by the drive unit 130. In the raising process, the movable cutter 400 may be pressed by the pressing plate 741 and may be thus brought into close contact with the fixed cutter 300.

In this case, the second home sensor 530 may detect an operating period by detecting the lower end portion of the movable cutter 400. When the detected operating period deviates from a normal range, the second home sensor 530 may determine that a jam of the roll paper 1 has occurred, and may stop the operation of the drive unit 130.

Meanwhile, the paper dust guide plate 710 formed at the upper end of the pressing plate 741 may guide paper dust, generated through the cutting of the roll paper 1, to the lower bezel 720, and may discharge the paper dust to the outside through the paper dust discharge hole 730.

Meanwhile, the kiosk printer 10, to which the paper cutting device according to an embodiment is applied, may further include an input/output unit 600 and a control unit 800, as shown in FIG. 8.

The input/output unit 600 is a component which receives input from a user and displays various types of printing-related information. For example, the input/output unit 600 may be implemented as a touch screen.

For example, the input/output unit 600 may allow input regarding an order menu for an order of a customer while outputting the order menu.

The control unit 800 may perform a post-process regarding a jam of the roll paper 1 while controlling the input/output unit 600 in response to detection signals of the above-described first home sensor 520 and the second home sensor 530.

More specifically, when a jam of the roll paper 1 is detected via the second home sensor 530, the control unit 800 may count a time until a detection signal of the first home sensor 520 attributable to the separation of the detection protrusion 510 is applied, and may output printing target information for the roll paper 1 to the input/output unit 600 when the counted time exceeds a set time.

In other words, when a jam of the roll paper 1 has occurred, the control unit 800 may count a time until the upper frame 200 which covers the transfer path of the roll paper 1 is opened in order to overcome the jam, and may provide printing target information for the roll paper 1 to the input/output unit 600 when the upper frame 200 has not been opened for the set time.

For example, the control unit 800 may provide an order number or receipt details, to be printed on the roll paper 1, to the input/output unit 600.

In this case, the control unit 800 may provide an input environment for external information to the input/output unit 600, and may store the input external information together with printing target information for the roll paper 1.

For example, when a receipt is not output due to a jam of the roll paper 1, the control unit 800 may display a screen configured to receive information about where to make contact (a telephone number, an e-mail address, or the like) from a user on the input/output unit 600 while providing corresponding printing target information to the input/output unit 600. When a user inputs information about where to make contact via the screen displayed on the input/output unit 600, the control unit 800 may transmit printing target information (a waiting sequential position number, receipt details, and the like) to the input/output unit 600 to the received where to make contact.

Meanwhile, in the case where the upper frame 200 has not been opened for the set time upon a jam of the roll paper 1, the control unit 800 may output printing target information for the roll paper 1 by providing the printing target information to another printer connected to the printer 10 while communicating with the other printer.

In this case, the control unit 800 may guide the output to be performed by the other printer via the input/output unit 600.

For example, the control unit 800 may search for adjacent printable printers and display a list of found printers on the input/output unit 600, thereby enabling a user to check the printable printers and to select a printer which will perform actual printing. Once a user has selected one from among the printers included in the list displayed on the input/output unit 600, the control unit 800 may request printing from the selected printer while transmitting printing target information to the selected printer.

Meanwhile, when the yoke 910 and the metal chip 920 constituting the above-described solenoid opening/closing member 900 are installed in the upper frame 200 and the lower frame 100 or the cover and the housing, respectively, the control unit 800 controls the solenoid opening/closing member 900 so that the upper frame 200 or the cover may be automatically opened when the repair or maintenance of the printer is required due to a paper jam, a paper shortage, or the like.

More specifically, when a jam of the roll paper 1 is detected via the second home sensor 530 or a shortage of the roll paper 1 is detected via the residual amount detection sensor of the paper holder 12, the control unit 800 removes the magnetism of the yoke 910 by applying power to the yoke 910 and thus separates the metal chip 920 from the yoke 910, thereby opening the upper frame 200 or the cover.

In this case, the control unit 800 may open the upper frame 200 by applying power to the yoke 910 until the detection signal of the first home sensor 520 is applied, and may block power applied to the yoke 910 when the detection signal of the first home sensor 520 is applied.

Meanwhile, the upper frame 200 may not be opened for various reasons, such as a jam of the roll paper 1 and the like, even in the case where the magnetism of the yoke 910 is removed by the control unit 800. Furthermore, even when the control unit 800 applies power to the yoke 910 to open the cover, the cover may not be opened due to a foreign material being caught between the cover and the housing. Accordingly, the controller 800 may check whether the upper frame 200 or the cover has been opened, and may repeatedly perform the operation of applying power to the yoke 910 when neither the upper frame 200 nor the cover have been opened. However, when an excessive current flows through the yoke 910, the solenoid coil wound around the yoke 910 may be burnt, so that the power may be applied only a certain number of times or for a certain period of time.

For example, the controller 800 may count the number of times power has been applied while applying power to the yoke 910 until the detection signal of the first home sensor 520 is applied or count a period of time until the detection signal of the first home sensor 520 is applied, and, when the counted number of times power has been applied or the period of time for which power has been applied exceeds a set value, may output a message directing a user to manually open the upper frame 200 to the input/output unit 600 and block power applied to the yoke 910.

In the following, an embodiment in which the cover is automatically opened when an event requiring a repair of the printer, such as a paper jam or a paper shortage, occurs will be described with reference to FIGS. 18 and 19. In the embodiment to be described below, it is determined according to a preset mode whether to automatically open the cover, to issue an electronic receipt or to request printing from another printer when an event requiring a repair of the printer occurs. The details thereof will be described below with reference to flowcharts.

Meanwhile, although the embodiment in which the cover of the kiosk printer is automatically opened will be described below, it will be apparent that the same approach may be applied to an embodiment in which the upper frame 200 is automatically opened.

FIGS. 18 and 19 are flowcharts illustrating a method of automatically opening the cover when an event requiring a repair of the kiosk printer occurs according to an embodiment.

Referring to FIG. 18, at step 1801, the controller 800 checks a mode set in the printer when an event requiring a repair of the printer occurs. In this case, the event requiring a repair of the printer refers to a paper jam, a paper shortage, or the like.

Although the mode of the printer may be set before an event occurs, a user may select a mode of the printer after an event has occurred. For example, when an event requiring a repair of the printer occurs and also an administrator (e.g., an employee in a store where the kiosk printer is installed) can offer help, a user may select a cover automatic opening mode. In contrast, when an event requiring a repair of the printer occurs but an administrator cannot offer help, the user may not select the automatic cover opening mode because the user cannot directly repair the cover even when the cover is opened.

If it is determined at step 1802 that the automatic cover opening mode has been set in the printer, the process proceeds to step 1803 and the controller 800 transmits a cover opening command. In this case, the controller 800 transmitting the cover open command may mean that the control unit 800 allows a current to flow through the coil 911 wound around the yoke 910 or blocks a current.

Meanwhile, if it is determined at step 1802 that the automatic cover opening mode has not been set in the printer, the process proceeds to step 1805 and the controller 800 may issue an electronic receipt or request print job to another printer. The detailed process of step 1805 will be described below with reference to FIG. 19.

After transmitting the cover opening command at step 1803, the controller 800 checks whether the cover has been opened at step 1804. The control unit 800 may check whether the cover has been opened via a sensor installed near the cover.

If it is determined at step 1804 that the cover has been opened, the process ends. However, even when the control unit 800 transmits the cover opening command, as described above, the cover may not be opened for various reasons. If it is determined at step 1804 that the cover has not been opened, the process proceeds to step 1806 and the controller 800 determines whether the number of times the cover opening command has been transmitted is smaller than "N." In this case, "N" may be preset based on a reason such as the durability of the solenoid coil wound on the yoke 910.

If, as a result of the determination at step 1806, the number of times the control unit 800 has transmitted the cover opening command is "N" or larger, the process proceeds to step 1807 and the control unit 800 may display a message directing a user to manually open the cover on the input/output unit 600.

If, as a result of the determination at step 1806, the number of times the control unit 800 has transmitted the cover opening command is smaller than "N," the process returns to step 1803 and the control unit 800 may retransmit the cover opening command.

Alternatively, although not shown in the drawings, at step 1806, the controller 800 may measure a period of time having elapsed from the time at which the cover opening command is transmitted first while periodically transmitting the cover opening command, instead of counting the number of times the cover open command has been transmitted. If the period of time having elapsed from the time at which the cover opening command was transmitted first falls within a preset period of time, the process proceeds to step 1803 and the controller 800 retransmits the cover opening command. In contrast, if the elapsed period of time is equal to or longer than the preset period of time, the process proceeds to step 1807 and the controller may display a message directing the user to manually open the cover on the input/output unit 600.

FIG. 19 is a flowchart illustrating a detailed process included in step 1805 of FIG. 18. Referring to FIG. 19, at step 1901, the controller 800 may display a screen inquiring whether to receive an electronic receipt or to print a receipt via another printer on the input/output unit 600. The user may select a desired method via the input/output unit 600.

The control unit 800 determines whether a user has selected the issuance of an electronic receipt at step 1902. If the issuance of an electronic receipt has not been selected, the process proceeds to step 1905 and the control unit 800 requests print job to another printable printer while transmitting print information to the printable printer. A detailed method of requesting printing from another printable printer is as described above. At step 1905, the print information transmitted from the control unit 800 to another printer may include markup language.

In contrast, if, as a result of the determination at step 1902, the user has selected the issuance of an electronic receipt, the process proceeds to step 1903 and the controller 800 displays a screen adapted to receive a destination address, to which an electronic receipt will be issued, on the input/output unit 600. The electronic receipt may be issued by email, by smartphone, etc. The user may enter an email address, a smartphone number, or the like, at which he or she wishes to receive the electronic receipt, onto the displayed screen.

If the user has input the destination address, to which the electronic receipt will be issued, via the input/output unit 600 at step 1903, the controller 800 issues the electronic receipt to the received destination address at step 1904.

As described above, the paper cutting device for a printer according to an embodiment and the kiosk printer 10 to which the paper cutting device is applied may easily remove or replace roll paper through the opening of a paper movement path upon a jam of roll paper or the replacement of roll paper because the paper movement path may be opened by the separation of the lower frame 100 and the upper frame 200 from each other, may prevent a safety-related accident attributable to the movable cutter 400 because the movable cutter 400 is automatically lowered to the lower frame 100 by the jam control unit 500 upon the opening of the paper movement path, and, in particular, may prevent a breakdown of the platen roller 110 or a breakdown of the thermal head 120 attributable to paper dust because paper dust generated through the cutting of the roll paper 1 may be guided to the lower bezel 720 via the configuration of the paper dust discharge unit 700.

Meanwhile, FIG. 9 is a perspective view showing a kiosk printer in which a paper guide device for a kiosk printer according to an embodiment is installed, FIG. 10 is a side view of the kiosk printer in which the paper guide device for a kiosk printer according to the embodiment is installed, and FIG. 11 is a perspective view showing the paper guide device for a kiosk printer according to the embodiment with a paper holder removed therefrom. Furthermore, FIG. 12 is a perspective view showing the rail member and guide members of the paper guide device for a kiosk printer according to the embodiment, FIG. 13 is a bottom perspective view showing the rail member and guide members shown in FIG. 12 when they are viewed from the opposite direction, and FIG. 14 is an exploded perspective view showing the rail member and guide members of the paper guide device for a kiosk printer according to the embodiment. Furthermore, FIG. 15 is an exploded perspective view showing the paper holder of the paper guide device for a kiosk printer according to the embodiment, and FIG. 16 is a view showing the configuration of the paper tube coupling rod shown in FIG. 15.

The paper guide device according to the present embodiment is a device which is installed in a housing 1000 constituting a part of a kiosk printer 10 and guides roll paper 1 toward a thermal head while guiding the moving roll paper 1 at a set width through the traction force of a platen roller.

More specifically, the paper guide device according to the present embodiment may include a paper holder 2000, a rail member 3000, and guide members 4000 disposed in the housing 1000, as shown in FIGS. 9 to 11.

In this case, the housing 1000 constituting a part of the kiosk printer 10 may include a base housing 1100 and a main unit housing 1200, as shown in FIGS. 9 and 10.

The base housing 1100 may be fastened to a printer case (not shown), and may contain various types of control modules for printing operations.

The main unit housing 1200 is configured to perform a printing operation on the roll paper 1 and then discharge the roll paper 1, and may be disposed on the top surface of the base housing 1100. The main unit housing 1200 may contain a platen roller configured to pull roll paper via rotating force, a thermal head configured to perform a printing operation on one surface of the roll paper 1, and a cutter configured to cut the roll paper 1 on which the printing operation has been performed.

The paper holder 2000 is a component which draws out the roll paper 1 through the traction force of the above-described platen roller while rotatably holding the roll paper 1.

The paper holder 2000 may be installed on the base housing 1100 constituting a part of the housing 1000 and provide a coupling portion for a paper tube provided at the center of the roll paper 1 so that the roll paper 1 can be rotatably coupled thereto, as shown in FIGS. 9 and 10.

More specifically, the paper holder 2000 may include paper supports 2100, paper tube coupling rods 2200, rod fastening members 2300, and residual amount detection sensors 2400, as shown in FIG. 15.

The paper supports 2100 are components which provide supporting force used to hold the roll paper 1. The paper supports 2100 may include a pair of paper supports, and may be fastened to the base housing 1100 in an opposite form.

The paper supports 2100 are each formed in a tubular shape or a sideways "U" section-shaped channel shape having an opening in the direction of the roll paper 1 so that the paper tube coupling rod 2200 to be described later can be slidably coupled thereto in the longitudinal direction.

In this case, the paper supports 2100 may expose the paper tube coupling rods 2200 to be described later through the opening, thereby enabling the residual amount detection sensors 2400 coupled to the paper tube coupling rods 2200 to detect the roll paper 1.

Meanwhile, at least one of the pair of paper supports 2100 may be movably coupled to the base housing 1100, and thus the pair of paper supports 2100 may be adjusted to a gap corresponding to the width of the roll paper 1.

In other words, the pair of paper supports 2100 may be adjusted to a gap corresponding to the width of the roll paper 1 while moving in a direction in which they become away from each other or they become close to each other.

For example, the paper support 2100 is movably installed by being fastened into a sliding groove (not shown) having an elongated hole shape provided in the base housing 1100 via a fastening bolt 2100*a*.

Alternatively, the paper support 2100 is movably fastened into a sliding groove via the elastic force of a spring (not shown) so that it can be moved by external force along a sliding groove having an elongated hole shape provided in the base housing 1100.

The paper tube coupling rods 2200 are components which rotatably support the paper tube of the roll paper 1.

More specifically, the paper tube coupling rods 2200 may be each configured such that one end portion thereof in the longitudinal direction thereof is coupled to the paper support 2100 via the rod fastening member 2300 in a length-adjustable manner and a fitting protrusion 2210 protrudes from the other end of the paper tube coupling rod 2200 and is fitted and coupled into the paper tube of the roll paper 1.

In other words, the paper tube coupling rods 2200 are slidably fitted into the paper supports 2100. Accordingly, the length of the paper tube coupling rods 2200 may be adjusted according to the size of the roll paper 1 in such a manner that they are extended from or retracted into the paper supports 2100, and the paper tube coupling rods 2200 may be fixed to the adjusted length by being fixed by the rod fastening members 2300.

The paper tube coupling rods 2200 are each provided with an accommodation space therein, thereby providing an installation space for the residual amount detection sensor 2400 to be described later and also provide an installation space for a fastening spring 2320 constituting a part of the rod fastening member 2300.

The rod fastening members 2300 are components which fasten the paper tube coupling rods 2200 to the paper supports 2100. Each of the rod fastening members 2300 may include a fastening shaft 2310 and a fastening spring 2320.

The fastening shaft 2310 is a component which fastens the paper support 2100 and the paper tube coupling rod 2200 to each other in such a manner that both ends thereof are caught on the paper support 2100 in the state of passing through the paper support 2100 and the paper tube coupling rod 2200.

In this case, a plurality of length adjustment holes 2110 may be formed in the paper support 2100 at predetermined intervals in the longitudinal direction of the paper support 2100, and a single coupling hole 2220 may be formed in the paper tube coupling rod 2200 and communicate with one of the length adjustment holes 2110.

Stop protrusions 2310*a* may be formed at both ends of the fastening shaft 2310, and the fastening shaft 2310 may be fastened by being stuck in the length adjustment hole 2110 via the stop protrusions 2310*a* in the state of being fitted into the coupling hole 2220 and the length adjustment hole 2110.

The fastening spring 2320 is a component which makes the length adjustment hole 2110 and the coupling hole 2220 off-centered by pressing the paper support 2100 via elastic force in the state of being installed on the paper tube coupling rod 2200.

In other words, the fastening shaft 2310 may be fitted in the state in which the length adjustment hole 2110 and the coupling hole 2220 communicate with each other in a straight line form, and may be fastened by being caught on the ends of the length adjustment hole 2110 via the stop protrusions 2310*a* as the length adjustment hole 2110 and the coupling hole 2220 are made off-centered by the pressing of the fastening spring 2320.

Accordingly, the fastening shaft 2310 may be fitted and fastened into the length adjustment hole 2110 and the coupling hole 2220 without a separate fastening member, such as an E-ring.

The residual amount detection sensor 2400 is a component which is coupled to the paper tube coupling rod 2200 and detects the residual amount of roll paper 1.

More specifically, the residual amount detection sensor 2400 may detect the residual amount of paper by radiating an infrared ray or light onto the roll paper 1 in the state of being coupled to the paper tube coupling rod 2200.

In this case, when the outer diameter of a paper tube constituting a part of the roll paper 1 is large, the residual amount detection sensor 2400 detects the paper tube other than the paper, but cannot detect the residual amount of paper.

Accordingly, the residual amount detection sensor 2400 may be configured to be coupled movably in the longitudinal direction of the paper tube coupling rod 2200 and move according to the outer diameter of the paper tube.

More specifically, the residual amount detection sensor 2400 may be movably coupled to the paper tube coupling rod 2200 via slider catch recesses 2510 and a sensor slider 2520, as shown in FIG. 15.

The slider catch recesses 2510 may include multi-stage slider catch recesses in the longitudinal direction of the paper tube coupling rod 2200.

The sensor slider 2520 may be movably caught on and fastened by one of the slider catch recesses 2510 while providing an installation portion for the residual amount detection sensor 2400, and may allow the location of the residual amount detection sensor 2400 to be adjusted while being moved in the longitudinal direction of the slider catch recesses 2510 by external force.

In this case, slider holes 2530 and a sensor hole 2540 which are formed in elongated hole shapes may be formed in the rear surface of the paper tube coupling rod 2200, as shown FIG. 16. The residual amount of paper may be detected by exposing the residual amount detection sensor 2400 through the sensor hole 2540 while allowing the sensor slider 2520 to be moved by external force via the slider holes 2530.

The rail member 3000 is a component which movably supports the guide members 4000 to be described later by providing a movement path in the widthwise direction of the roll paper 1, as shown in FIG. 11.

More specifically, the rail member 3000 may be disposed between the paper holder 2000 and the thermal head while being disposed on the main unit housing 1200 in which the thermal head and the platen roller are disposed.

The rail member 3000 may include a rail rod 3100 and a rail housing 3200, as shown in FIGS. 12 and 13.

The rail rod 3100 may be coupled to the main unit housing 1200 via the rail housing 3200 to be described later, and may provide coupling portions for the guide members 4000 to be described later.

The rail rod 3100 may be implemented as a metal rod.

The rail housing 3200 is a component which prevents the rail rod 3100 from being exposed while providing fastening portions for both ends of the rail rod 3100 in the longitudinal direction of the rail rod 3100.

In other words, the rail housing 3200 may be formed in a sideways "U" section-shaped channel shape having an opening on its one side and be fastened in the state of accommodating the rail rod 3100, as shown in FIG. 13.

Accordingly, the rail housing 3200 may prevent the rail rod 3100 from being exposed to the outside, as shown in FIG. 12.

The rail housing 3200 may be provided with rail brackets 3210 configured to be fastened to the main unit housing 1200 at both ends thereof and be disposed on the main unit housing 1200, as shown in FIG. 11.

The guide members 4000 are components which guide the roll paper 1 to the main unit housing 1200 in which the thermal head, the platen roller and the cutter are disposed while supporting both end portions of the roll paper 1 in the widthwise direction of the roll paper 1. The guide members 4000 may include a pair of guide members and be adjusted to a set gap while being moved by external force in the state of being movably coupled to the rail member 3000, as shown in FIGS. 11 and 12.

More specifically, each of the guide members 4000 may include a sliding block 4100 and a guide plate 420, as shown in FIGS. 13 and 14.

The sliding block 4100 is a component which may be coupled in the state of holding the above-described rail rod 3100 and provide supporting force used to support the roll paper 1 and may be partially exposed out of the rail housing 3200 and be moved along the rail rod 3100 while being allowed to be moved by external force.

The sliding block 4100 may be made of a plastic material or synthetic resin material having an elastic force unlike the rail rod 3100 made of a metal material. The sliding block 4100 may include a clamping portion 4110 and a block portion 4120, as shown in FIG. 14.

The clamping portion 4110 is a component which is fitted over the rail rod 3100. The clamping portion 4110 may be formed in a shape capable of surrounding the rail rod 3100, and may be fastened in the state of holding the rail rod 3100 via elastic force in a direction in which the clamping portion 4110 is retracted.

The clamping portion 4110 may provide supporting force in a fastened state by pressing the rail rod 3100 via the elastic force in the direction in which the clamping portion 4110 is retracted, and may slide and move along the rail rod 3100 when external force in the direction of the rail rod 3100 is applied via the guide plate 4200.

In this case, the clamping portion 4110 may be coupled by holding the rail rod 3100, and may be accommodated inside the above-described rail housing 3200 along with the rail rod 3100.

The block portion 4120 is a component which provides a coupling portion for the guide plate 4200 to be described later. The block portion 4120 may be formed in a block shape under the clamping portion 4110 in the state of being connected to the clamping portion 4110, and may extend out of the rail housing 3200.

In other words, the sliding block 4100 may be fitted over the rail rod 3100 through the clamping portion 4110, and may be coupled to the guide plate 4200 through the block portion 4120.

The guide plate 4200 is a component which guides the roll paper 1 through its movement by supporting an end of the roll paper 1 in the widthwise direction of the roll paper 1 in such a manner as to provide a wall to a side of the roll paper 1 in the widthwise direction of the roll paper 1.

The guide plate 4200 may be implemented as a metal plate. The guide plate 4200 may be coupled to the block portion 4120 constituting a part of the above-described sliding block 4100, and may be moved along the rail rod 3100 along with the sliding block 4100.

More specifically, the guide plate 4200 may include a housing coupling portion 4210, a guide portion 4220, and a block coupling portion 4230, as shown in FIG. 14.

The housing coupling portion 4210 is a component which forms a coupling portion for the above-described rail housing 3200. The housing coupling portion 4210 may be formed in a recess shape in order to surround the rail housing 3200, may be fitted and coupled into the rail housing 3200, and may be moved in the longitudinal direction of the rail housing 3200.

The guide portion 4220 is a component which supports an end of the roll paper 1 in the widthwise direction of the roll paper 1. The guide portion 4220 may extend upward from the housing coupling portion 4210, and may provide a wall to an end of the roll paper 1 in the widthwise direction of the roll paper 1.

In this case, the guide portion 4220 may extend in a vertical direction, and a bending portion 4220*a* may be formed at the upper end of the guide portion 4220.

The bending portion 4220*a* may be bent such that it is bent toward the direction opposite to the direction of the roll paper 1 to be gradually away from the roll paper 1 in the direction of the upper end of the bending portion 4220*a*, thereby setting new roll paper 1 in place by guiding the new roll paper 1 toward the guide portion 4220 when the existing roll paper 1 is replaced with the new roll paper 1.

The block coupling portion 4230 is a component which provides a coupling portion for the block portion 4120 constituting a part of the above-described sliding block 4100.

More specifically, the block coupling portion 4230 may be formed below the housing coupling portion 4220 in a perpendicular state, and may be coupled to the sliding block 4100.

In other words, the guide plate 4200 may be coupled to the sliding block 4100 through the block coupling portion 4230, and may be moved along the rail rod 3100 along with the sliding block 4100 when external force is applied by a user.

In this case, the metallic guide plate 4200 is coupled via the synthetic resin sliding block 4100 without being directly coupled to the metallic rail rod 3100, and thus noise may be reduced during movement and smoother movement may be achieved.

The operation of the paper guide device for a kiosk printer according to the embodiment, which includes the above-described components, will be described below.

When the roll paper 1 is mounted, the paper tube coupling rods 2200 constituting parts of the paper holder 2000 may be adjusted to a length corresponding to the size of the roll paper 1 via the rod fastening members 2300.

In this case, the residual amount detection sensor 2400 may be adjusted to a location corresponding to the outer diameter of the paper tube of the roll paper 1 while being moved along the slider catch recess 2510 along with the sensor slider 2520 by the external force of a user.

Furthermore, the paper tube coupling rods 2200 may be rotatably coupled to the paper tube of the roll paper 1 via the fitting protrusions 2210, thereby supporting the roll paper 1 so that the roll paper 1 can be drawn out.

The roll paper 1 may be coupled to be drawn out by the traction force of the platen roller in such a manner that the front end of the roll paper 1 is coupled to the main unit housing 1200 in the state in which the roll paper 1 is mounted on the paper tube coupling rods 2200.

In this case, the guide plates 4200 constituting parts of the guide members 4000 may set the roll paper 1 in place by guiding the roll paper 1 to the guide portions 4220 via bending portions 4220*a* which are bent to be spread from each other.

Meanwhile, when the gap between the guide members 4000 is adjusted, the guide plates 4200, together with the corresponding sliding blocks 4100, may be moved to set locations along the rail rod 3100 by external force, and may be fastened to the rail rod 3100 via the elastic force of the clamping portions 4110 of the sliding blocks 4100 after the completion of the movement, thereby enabling supporting force to be provided.

As described above, in the paper guide device for a printer according to the present embodiment, the pair of guide members 4000 support both ends of the roll paper 1 in the state of being movably coupled to the rail member 3000, and thus the roll paper 1 may be stably guided toward the thermal head. In particular, the guide members 4000 are configured to be movable by external force, and may be thus adjusted to a gap corresponding to the width of the roll paper 1.

According to any one of the above-described technical solutions, there is proposed the kiosk printer in which the paper movement path can be opened as the lower frame on which the movable cutter is disposed and the upper frame on which the fixed cutter is disposed are separated from each other, and thus roll paper can be easily removed or replaced through the opening of the paper movement path when a paper jam occurs or roll paper is replaced.

More specifically, the movable cutter is disposed on the lower frame, and thus the paper movement path can be easily opened through the separation of the upper frame. When the paper movement path is opened, the movable cutter is automatically lowered to the lower frame by the jam control unit, and thus a safety-related accident attributable to the movable cutter can be prevented.

Furthermore, the drive unit configured to drive the movable cutter can be manually operated by the manual control unit, and thus a jam of roll paper can be removed or roll paper can be replaced even in a situation, such as a power failure, by forcibly raising the movable cutter via the manual control unit.

Furthermore, in connection with the pressing member configured to bring the movable cutter into close contact with the fixed cutter, the movable cutter is pressed using the pressing plate and the conical springs, and thus the pressing member applicable to a narrow installation space can be implemented.

Furthermore, the lower and upper bezels which form the outlet of the paper movement path in the state of being adjacent to the pressing member are disposed on the lower frame and the upper frame, respectively, and may be opened, and thus roll paper can be mounted without being inserted between the bezels.

Furthermore, paper dust generated by the cutting of roll paper can be guided to the lower bezel by the paper dust discharge unit, and thus a breakdown of the platen roller or thermal head attributable to paper dust can be prevented.

Furthermore, the jam control unit determines that a jam of roll paper has occurred when the movable cutter has not returned within a set time while detecting the operating period of the movable cutter, and thus a jam of roll paper can be smoothly detected.

Furthermore, when a jam of roll paper has occurred, the display control unit constituting a part of the jam control unit outputs printing target information via a display, and thus printing target information, such as a receipt or order information, can be provided even when the jam is not removed.

Furthermore, the display control unit provides an environment for the input of external information via the display, and thus an electronic receipt can be provided through, e.g., the input of e-mail information.

Furthermore, the display control unit outputs printing target information via another printer, and thus the delay of operation attributable to a paper jam can be eliminated.

According to any one of the above-described technical solutions, there is proposed the paper guide device for a kiosk printer, in which roll paper can be stably guided toward the thermal head because the pair of guide members support both ends of the roll paper in the state of being movably coupled to the rail member and in which, in particular, the guide members can be adjusted to a gap corresponding to the width of roll paper because they are configured to be movable by external force.

Furthermore, the rail rod which provides the movement path of the guide members is prevented from being exposed by the rail housing, and thus not only the rail rod but also the coupling portions of the rail rod and the guide members are protected from an external environment, thereby improving durability.

Furthermore, the sliding block constituting a part of each of the guide members is fitted over the rail rod via the elastic force of a gripping portion, and thus the sliding block can provide supporting force at a set location and can be smoothly moved in the longitudinal direction of the rail rod when external force is applied.

Furthermore, the guide portions constituting parts of the guide plates are formed to be spread outward from roll paper in a direction toward the upper end portions thereof, and thus the roll paper can be easily set in place by being guided to a location between the guide portions when the roll paper is replaced.

Furthermore, the paper tube coupling rods constituting parts of the paper holder are coupled into the paper supports so that the length thereof can be adjusted, and thus the paper tube coupling rods can be adjusted to a length suitable for the size of the roll paper. When the paper tube coupling rods are fastened to the paper support, they can be securely fastened without requiring a separate fastening member, such as a fastening ring.

Furthermore, at least one of the paper tube coupling rods is provided with the residual amount detection sensor, and thus the residual amount of roll paper can be detected. In particular, when the residual amount detection sensor is coupled to be movable in the longitudinal direction of the paper tube coupling rod, the location of the residual amount detection sensor can be adjusted according to the thickness of a paper tube constituting a part of roll paper.

Moreover, when an event requiring a repair of the internal configuration of the printer occurs, the cover of the printer is automatically opened according to a preset mode or a preset alternative task such as requesting printing from another printer is performed, thereby providing an advantage of rapidly and conveniently overcoming a problem.

The effects which may be acquired by the disclosed embodiments are not limited to the above-described effects, and other effects which have not been described above will be clearly understood by those having ordinary knowledge in the art, to which the disclosed embodiments pertain, from the foregoing description.

The above-described embodiments are intended merely for illustrative purposes. It will be understood that those having ordinary knowledge in the art to which the present invention pertains can easily make modifications and variations without changing the technical spirit and essential features of the present invention. Therefore, the above-described embodiments are illustrative and are not limitative in all aspects. For example, each component described as being in a single form may be practiced in a distributed form. In the same manner, components described as being in a distributed form may be practiced in an integrated form.

The scope of the present invention should be defined by the attached claims, rather than the detailed description. Furthermore, all modifications and variations which can be derived from the meanings, scope and equivalents of the claims should be construed as falling within the scope of the present invention.

What is claimed is:

1. A paper cutting device for a printer, the paper cutting device cutting paper which is printed with information by a thermal head while being moved by traction force of a platen roller, the paper cutting device comprising:

a first frame configured to provide a paper movement path for the paper to a surface and a drive unit for providing driving force is contained therein;

a second frame configured to form the paper movement path for the paper in association with the first frame in a state of being coupled to the surface of the first frame, and to be separated from the first frame and open the paper movement path, thereby allowing the paper to be replaced or mounted;

a fixed cutter configured to be disposed on the second frame, and to cut the paper;

a movable cutter configured to be disposed on the first frame to be reciprocated, to cut the paper in association with the fixed cutter while being approached to the fixed cutter, and to allow the paper to move by being returned to the first frame; and a jam control unit configured to detect a jam of the paper by detecting operating status of the movable cutter, and lower the movable cutter to the first frame; and a paper material discharge unit configured to discharge paper material, generated from the paper which is cut by the movable cutter, to an outside, wherein the paper material discharge unit comprises;

a pressing member configured to be disposed on the first frame, to bring the movable cutter into close contact with the fixed cutter by pressing the movable cutter when the movable cutter is approached.

2. The paper cutting device of claim 1, further comprising a jam control unit configured to detect a jam of the paper by detecting operating status of the movable cutter, and to detect opening of the paper movement path performed by the second frame and return the movable cutter to the first frame, wherein the jam control unit comprises:

a detection protrusion configured to protrude from the second frame;

a first home sensor configured to be provided on the first frame, form a coupling portion for the detection protrusion and detect the detection protrusion, and to, when the detection protrusion is separated, apply a detection signal to the drive unit and return the movable cutter; and a second home sensor configured to be provided on the first frame and detect an operating period of the movable cutter while detecting an end portion of the movable cutter, to detect whether or not a jam of the paper has occurred based on the detected operating period, and to control the drive unit by applying a detection signal to the drive unit.

3. The paper cutting device of claim 1, wherein the paper material discharge unit further comprises a paper material guide plate configured to be formed on a top of the first frame in a longitudinal direction of the movable cutter, to form a part of the paper movement path, and to guide paper material, falling from the paper, to an outlet of the paper movement path.

4. The paper cutting device of claim 3, wherein the paper material discharge unit further comprises a lower bezel configured to be disposed on the first frame in a state of being adjacent to the paper material guide plate, to form the outlet of the paper movement path, and to receive the paper material from the paper material guide plate and discharge the paper material to the outside.

5. The paper cutting device of claim 4, wherein the paper material discharge unit further comprises a paper material discharge hole configured to be formed in the lower bezel, and to discharge the paper material, guided by the paper material guide plate, from the lower bezel.

6. The paper cutting device of claim 3, wherein the pressing member reciprocates the paper material guide plate in a longitudinal direction of the paper movement path.

7. The paper cutting device of claim 6, wherein the pressing member comprises:

a pressing plate configured to be contained in the first frame and allow one surface thereof to be pressed in a direction of the movable cutter by external force, to be reciprocated in a horizontal direction while being brought close to the movable cutter or separated from the movable cutter by raising or lowering of the movable cutter, and to be integrated with the paper material guide plate and reciprocate the paper material guide plate; and at least one pressing spring configured to support the first frame in a state of being fastened to one surface of the pressing plate, and to press the pressing plate toward the movable cutter while providing elastic force.

8. The paper cutting device of claim 7, wherein the pressing spring is a conical coil spring in which a diameter of a coil of the conical coil spring decreases gradually in a direction from the pressing plate to the first frame.

9. The paper cutting device of claim 7, wherein the pressing spring comprises a plurality of pressing springs, and the plurality of pressing springs is disposed on a central portion of the pressing plate in a longitudinal direction of the pressing plate.

* * * * *